US007507509B2

(12) United States Patent
Nagai et al.

(10) Patent No.: US 7,507,509 B2
(45) Date of Patent: Mar. 24, 2009

(54) ELECTROPHOTOGRAPHIC PHOTORECEPTOR, AND IMAGE FORMING METHOD, IMAGE FORMING APPARATUS AND PROCESS CARTRIDGE USING THE ELECTROPHOTOGRAPHIC PHOTORECEPTOR

(75) Inventors: Kazukiyo Nagai, Numazu (JP); Tetsuro Suzuki, Fuji (JP); Hiroshi Tamura, Susono (JP); Hongguo Li, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 515 days.

(21) Appl. No.: 11/245,135

(22) Filed: Oct. 7, 2005

(65) Prior Publication Data

US 2006/0078809 A1 Apr. 13, 2006

(30) Foreign Application Priority Data

Oct. 7, 2004 (JP) ..... 2004-295214

(51) Int. Cl.
*G03G 5/047* (2006.01)

(52) U.S. Cl. ..... 430/58.7; 430/59.6; 430/96

(58) Field of Classification Search ..... 430/59.6, 430/96, 58.7

See application file for complete search history.

(56) References Cited

U.S. PATENT DOCUMENTS

| | | | |
|---|---|---|---|
| 5,322,753 | A | 6/1994 | Tamura et al. |
| 5,492,784 | A | 2/1996 | Yoshikawa et al. |
| 5,608,010 | A | 3/1997 | Tamura et al. |
| 5,723,243 | A | 3/1998 | Sasaki et al. |
| 5,747,204 | A | 5/1998 | Anzai et al. |
| 5,789,128 | A | 8/1998 | Adachi et al. |
| 5,830,980 | A | 11/1998 | Anzai et al. |
| 5,840,454 | A | 11/1998 | Nagai et al. |
| 5,846,680 | A | 12/1998 | Adachi et al. |
| 5,853,935 | A | 12/1998 | Suzuki et al. |
| 5,871,876 | A | 2/1999 | Ikuno et al. |
| 5,910,561 | A | 6/1999 | Adachi et al. |
| 5,942,363 | A | 8/1999 | Tanaka et al. |
| 5,976,746 | A | 11/1999 | Tanaka et al. |
| 6,018,014 | A | 1/2000 | Nagai et al. |
| 6,027,846 | A | 2/2000 | Shimada et al. |
| 6,030,733 | A | 2/2000 | Kami et al. |
| 6,045,959 | A | 4/2000 | Katayama et al. |
| 6,066,428 | A | 5/2000 | Katayama et al. |
| 6,069,224 | A | 5/2000 | Adachi et al. |
| 6,093,784 | A | 7/2000 | Tamura et al. |
| 6,130,310 | A | 10/2000 | Katayama et al. |
| 6,151,468 | A | 11/2000 | Kami et al. |
| 6,172,176 | B1 | 1/2001 | Tanaka et al. |
| 6,187,492 | B1 | 2/2001 | Ri et al. |
| 6,187,494 | B1 | 2/2001 | Kawamura et al. |
| 6,191,249 | B1 | 2/2001 | Tanaka et al. |
| 6,194,535 | B1 | 2/2001 | Katayama et al. |
| 6,210,848 | B1 | 4/2001 | Nagai et al. |
| 6,303,736 | B1 | 10/2001 | Kawamura et al. |
| 6,316,577 | B1 | 11/2001 | Shimada et al. |
| 6,326,112 | B1 | 12/2001 | Tamura et al. |
| 6,444,387 | B2 | 9/2002 | Ri et al. |
| 6,486,293 | B1 | 11/2002 | Ri et al. |
| 6,492,079 | B2 | 12/2002 | Shimada et al. |
| 6,548,216 | B2 | 4/2003 | Kawamura et al. |
| 6,576,386 | B1 | 6/2003 | Ri et al. |
| 6,596,449 | B2 | 7/2003 | Shimada et al. |
| 6,641,964 | B2 | 11/2003 | Ikuno et al. |
| 6,664,361 | B2 | 12/2003 | Sasaki et al. |
| 6,790,571 | B2 | 9/2004 | Kawamura et al. |
| 6,790,572 | B2 | 9/2004 | Tamoto et al. |
| 6,844,124 | B2 | 1/2005 | Ikuno et al. |
| 6,849,367 | B2 | 2/2005 | Shoshi et al. |
| 6,858,362 | B2 | 2/2005 | Tamoto et al. |
| 6,899,983 | B2 | 5/2005 | Tamoto et al. |
| 6,919,419 | B2 * | 7/2005 | Ri et al. ..... 528/196 |
| 6,936,388 | B2 | 8/2005 | Suzuki et al. |
| 6,939,651 | B2 | 9/2005 | Li et al. |

(Continued)

FOREIGN PATENT DOCUMENTS

| | | |
|---|---|---|
| JP | 56-048637 | 5/1981 |

(Continued)

OTHER PUBLICATIONS

U.S. Appl. No. 11/561,983, filed Nov. 21, 2006, Sugino et al.

(Continued)

*Primary Examiner*—John L Goodrow
(74) *Attorney, Agent, or Firm*—Oblon, Spivak, McClelland, Maier & Neustadt, P.C.

(57) ABSTRACT

An electrophotographic photoreceptor, including a crosslinked material including:

units obtained from a radical polymerizing monomer A having three or more radical polymerizing groups;

a compound B having the following formula (1):

$$B_1—Ar_1—CH=CH—Ar_2—B_2 \quad (1)$$

wherein $Ar_1$ represents a substituted or an unsubstituted monovalent group or bivalent group formed of an aromatic hydrocarbon skeleton; $Ar_2$ represents a monovalent group or a bivalent group formed of an aromatic hydrocarbon skeleton or heterocyclic compound skeleton having one or more tertiaryamino group; and at least one of $B_1$ and $B_2$ is a hydrogen atom, and the other is an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group; and a photo polymerization initiator.

17 Claims, 2 Drawing Sheets

U.S. PATENT DOCUMENTS

| | | | | |
|---|---|---|---|---|
| 2003/0198881 | A1 | 10/2003 | Kawamura et al. | |
| 2004/0053152 | A1 | 3/2004 | Nagai et al. | |
| 2004/0131960 | A1 | 7/2004 | Kawamura et al. | |
| 2004/0197688 | A1 | 10/2004 | Tamoto et al. | |
| 2004/0248024 | A1 | 12/2004 | Suzuki et al. | |
| 2004/0253527 | A1 | 12/2004 | Suzuki et al. | |
| 2005/0003287 | A1* | 1/2005 | Kawamura et al. | 430/96 |
| 2005/0100804 | A1 | 5/2005 | Tamoto et al. | |
| 2005/0106483 | A1 | 5/2005 | Shoshi et al. | |
| 2005/0175911 | A1 | 8/2005 | Tamoto et al. | |

FOREIGN PATENT DOCUMENTS

| | | |
|---|---|---|
| JP | 64-001728 | 1/1989 |
| JP | 04-281461 | 10/1992 |
| JP | 05-216249 | 8/1993 |
| JP | 08-262779 | 10/1996 |
| JP | 2000-066425 | 3/2000 |

OTHER PUBLICATIONS

U.S. Appl. No. 11/480,517, filed Jul. 5, 2006, Yanagawa et al.

* cited by examiner

ELECTROPHOTOGRAPHIC PHOTORECEPTOR, AND IMAGE FORMING METHOD, IMAGE FORMING APPARATUS AND PROCESS CARTRIDGE USING THE ELECTROPHOTOGRAPHIC PHOTORECEPTOR

BACKGROUND OF THE INVENTION

1. Field of the Invention

The present invention relates to an electrophotographic photoreceptor, and to an image forming method, an image forming apparatus and process cartridge using the electrophotographic photoreceptor.

2. Discussion of the Background

Recently, organic photoreceptors (OPCs: organic photo conductors) have been widely used instead of inorganic photoreceptors for copiers, facsimiles, laser printers and their complex machines because of their good performances and advantages. Specific examples of the reasons include (1) optical properties such as a wide range of light absorbing wavelength and a large amount of absorbing light; (2) electrical properties such as high sensitivity and stable chargeability; (3) choice of the materials; (4) good manufacturability; (5) low cost; (6) non-toxicity, etc.

On the other hand, as image forming apparatuses become smaller, photoreceptors have smaller diameters recently. In addition, photoreceptors are required to have high durability as image forming apparatuses produce images at a higher speed and are free from maintenance. In this respect, the organic photoreceptor typically has a soft surface layer mainly formed from a low-molecular-weight charge transport material and an inactive polymer, and therefore the organic photoreceptor typically has a drawback of being mechanically abraded with an image developer and a cleaner with ease when repeated used in the electrophotographic process.

In addition, as toner particles has smaller particle diameters due to requirements for high-quality images, cleaning blades need to have higher rubber hardness and higher contact pressure for the purpose of increasing cleanability, and which also accelerates abrading photoreceptors. Such abrasions of photoreceptors deteriorate electrical properties thereof such as sensitivities and chargeabilities, and cause abnormal images such as image density deterioration and background fouling. When a photoreceptor is locally abraded, images having black stripes due to defective cleaning are produced. Therefore, the following trials have been made to improve the abrasion resistance.

(1) Japanese Laid-Open Patent Publication No. 56-48637 discloses a photoreceptor using a hardening binder in its surface layer; (2) Japanese Laid-Open Patent Publication No. 64-1728 discloses a photoreceptor using charge transport polymer material; (3) Japanese Laid-Open Patent Publication No. 4-281461 discloses a photoreceptor having a surface layer wherein an inorganic filler is dispersed; (4) Japanese Patent No. 3262488 discloses a photoreceptor having a protection layer including a hardened multifunction alacrylate monomer; (5) Japanese Patent No. 3194392 discloses a method of forming a charge transport layer using a coating liquid formed from a monomer having a carbon-carbon double bond, a charge transport material having a carbon-carbon double bond and a binder resin; and (6) Japanese Laid-Open Patent Publication No.2000-66425 discloses a photosensitive layer including a hardened positive hole transport compound having two or more chain polymerizing functional groups in the same molecule.

Although the abrasion resistance has been more improved than that of the conventional photoreceptors thereby, there rises a new problem. The conventional photoreceptors do not produce defective images for long even when having foreign particles or damages on the surface thereof because of being refaced by the abrasion. However, the improved photoreceptors continue to produce defective images for long once having foreign particles or damages on the surface thereof.

Particularly, the recent toners having a smaller particle diameter and a low softening point for producing higher quality images and saving energy include inorganic particulate materials such as silica to improve the fluidity in many cases. The silica occasionally sticks in the surface of the photoreceptor and the toner constituents such as wax accumulate around there, resulting in production of white spotted defective images.

Because of these reasons, a need exists for a long-life photoreceptor, having good abrasion resistance and electrical properties, and producing less white spotted defective images.

SUMMARY OF THE INVENTION

Accordingly, an object of the present invention is to provide a long-life photoreceptor, having good abrasion resistance and electrical properties, and producing less white spotted defective images.

Another object of the present invention is to provide an image forming method producing higher quality images using the photoreceptor.

A further object of the present invention is to provide an image forming apparatus producing higher quality images using the photoreceptor.

Another object of the present invention is to provide a process cartridge for image forming apparatus, producing higher quality images using the photoreceptor.

These objects and other objects of the present invention, either individually or collectively, have been satisfied by the discovery of an electrophotographic photoreceptor, comprising a crosslinked material comprising:

units obtained from a radical polymerizing monomer A having three or more radical polymerizing groups;

a compound B having the following formula (1):

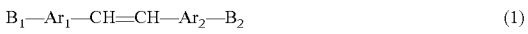

$$B_1—Ar_1—CH{=}CH—Ar_2—B_2 \quad (1)$$

wherein $Ar_1$ represents a substituted or an unsubstituted monovalent group or bivalent group formed of an aromatic hydrocarbon skeleton; $Ar_2$ represents a monovalent group or a bivalent group formed of an aromatic hydrocarbon skeleton or heterocyclic compound skeleton having one or more tertiary amino group; and at least one of $B_1$ and $B_2$ is a hydrogen atom, and the other is an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group; and a photo polymerization initiator.

The crosslinked material is preferably has a gel fraction not less than 95%, and more preferably not less than 97%.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
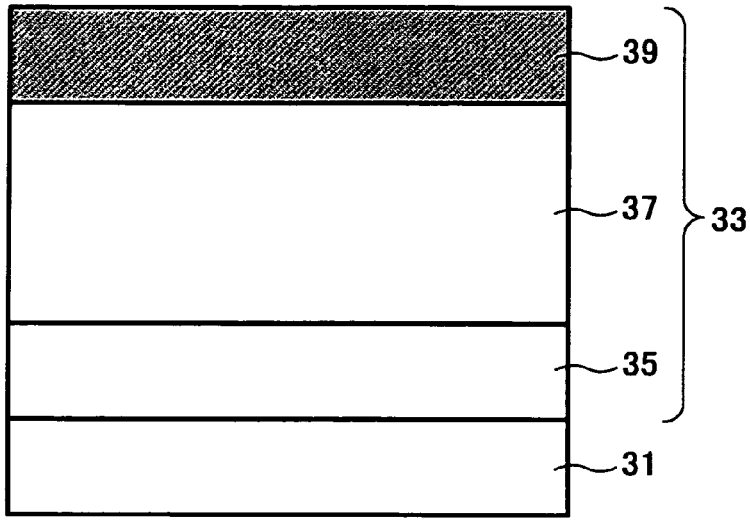
FIG. 1 is a cross-sectional view of an embodiment of coated layers of the electrophotographic photoreceptor of the present invention.

The present invention provides a long-life photoreceptor, having good abrasion resistance and electrical properties, and producing less white spotted defective images, when comprising the above-mentioned crosslinked material.

The crosslinked material is preferably has a gel fraction not less than 95%, and more preferably not less than 97% to improve the abrasion resistance.

In addition, the radical polymerizing monomer A having three or more radical polymerizing groups is effectively used to improve the abrasion resistance and damage resistance. It is considered that a multifunctional monomer having 5 to 6 radical polymerizing groups is used to further improve this. However, a combination of the a multifunctional monomer having 5 to 6 radical polymerizing groups and a charge transport material produces a crosslinked material having poor surface smoothness in many cases, and the resultant photoreceptor has striped undulations, dimples and a difference of elevation of a few μm on the surface. A photoreceptor having such a surface is liable to be poorly cleaned even when having good abrasion resistance. When the charge transport material is the compound B of the present invention, the radical polymerizing monomer A is preferably a mixture of a monomer having 3 functional groups and a monomer having 5 to 6 functional groups because the resultant photoreceptor has very good abrasion resistance and damage resistance while maintaining the surface smoothness.

The present invention is basically an electrophotographic photoreceptor, the surface of which includes a crosslinked film as a hardened coated composition, which is obtained by polymerizing a radical polymerizing monomer having three or more radical polymerizing groups; an ester(meth)acrylate compound or a vinyl compound having a specific structure; and photo polymerization initiator.

The surface layer of the conventional photoreceptor is formed of a thermoplastic resin wherein a low-molecular-weight charge transport material is dispersed, and is softer than inorganic fillers such as silica and the inorganic filler is considered to easily stick therein. Therefore, the surface layer needs to be harder. This is not improved with a polymer charge transport resin instead of the low-molecular-weight charge transport material, and a crosslinked resin, particularly a crosslinked resin having higher crosslinking density is required. Therefore, a crosslinked film using a multifunctional monomer is advantageously used.

On the other hand, the crosslinked film needs to include a charge transport constituent such that the resultant photoreceptor has good electrical properties. The charge transport constituent typically has a bulky constitution having a triarylamine structure, a molecular weight larger than that of a convention al polymerizing monomer, and the crosslinked film does not have sufficient crosslinking density because of the charge transport constituent.

Trials to form a crosslinked film having high crosslinking density are made using multifunctional monomer as the polymerizing monomer and a multifunctional polymerizing group as the charge transport constituent. However, the crosslinked film including the bulky charge transport constituents has a crack or becomes fragile. It is considered that a flexible group is used between the polymerizing monomer and the charge transport constituent to prevent this, which is contrary to increasing the hardness of the crosslinked film.

When a triphenylamine structure as a minimum unit of the triarylamine structure has a polymerizing group, the charge transportability is insufficient and the resultant photoreceptor has poor electrical properties. Therefore, the charge transport constituent preferably has a skeleton properly expanding the conjugation length, which is contrary to increasing the crosslinking density.

The ester(meth)acrylate compound or vinyl compound having a specific structure of the present invention as a charge transport constituent has the following properties.

The ester(meth)acrylate compound or vinyl compound having a specific structure is a tertiary amine compound having a stilbene conjugation structure and good hole transportability, and has a highly radical-polymerizing acryloyloxy group, a methacryloyloxy group or a vinyl group. The ester (meth)acrylate compound or vinyl compound quickly gelates when radical-polymerized and does not have an excessive crosslink strain. The double-bonding of the stilbene conjugation structure partially participates in the polymerization, and less polymerizes than the acryloyloxy group, methacryloyloxy group or vinyl group, which causes a time difference in the crosslinking reaction and the strain is not maximized. In addition, the double-bonding participating in the polymerization can increase the number of crosslinking reactions per a molecular weight, resulting in higher crosslinking density. Further, the double-bonding can control the polymerization with the crosslinking conditions, and can easily form a most suitable crosslinked film. The double-bonding of the stilbene conjugation structure originally having a low polymerization grade has the characteristics of forming a crosslinked material wherein the inner, the less the number of reactions. A crosslinked material having such a gradient of the crosslinking density can be formed within a thickness of from about 2 to 15 μm. This prevents the crosslinked layer having quite a hard surface and free from damages from peeling off from an underlayer softer than the crosslinked layer.

Particularly when a mixture of a monomer having 3 functional groups and a monomer having 5 to 6 functional groups is used as the radical polymerizing monomer A, the double-bonding of the stilbene conjugation structure participates in the crosslinking reaction, resulting in a crosslinked material having better surface smoothness, surface hardness and total abrasion resistance.

Such a reaction can be performed with the ester(meth) acrylate compound or vinyl compound of the present invention, but cannot be performed with e.g., an α-phenylstilbene double bonding.

Next, each constituent will be explained.

Radical Polymerizing Monomer A Having Three or More Radical Polymerizing Groups

The radical polymerizing monomer having three or more radical polymerizing groups for use in the present invention represents a monomer which neither has a positive hole transport structure such as triarylamine, hydrazone, pyrazoline and carbazole nor has an electron transport structure such as condensed polycyclic quinone, diphenoquinone, a cyano group and an electron attractive aromatic ring having a nitro group, and has three or more radical polymerizing functional groups. Any radical polymerizing functional groups can be used, provided they have a carbon-carbon double bonding and capable of radically polymerizing.

Specific examples of the radical polymerizing functional groups include the following 1-substituted ethylene functional groups and 1,1-substituted ethylene functional groups.

Specific examples of the 1-substituted ethylene functional groups include functional groups having the following formula:

$$CH_2{=}CH{-}X_1{-}$$

wherein $X_1$ represents a substituted or an unsubstituted phenylene group, an arylene group such as anaphthylene group, a substituted or an unsubstituted alkenylene group, a —CO-group, a —COO-group and a —CON ($R_{10}$) -group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group.

Specific examples of the substituents include vinyl groups, styryl groups, 2-methyl-1,3-butadienyl groups, vinylcarbonyl groups, acryloyloxy groups, acryloylamide groups, vinylthioether groups, etc.

Specific examples of the 1,1-substituted ethylene functional groups include functional groups having the following formula:

$$CH_2{=}CH(Y){-}X_2{-}$$

wherein $Y_1$ represents a substituted or an unsubstituted alkyl group, a substituted or an unsubstituted aralkyl group, a substituted or an unsubstituted phenyl group, an aryl group such as a naphtyl group, a halogen atom, a cyano group, a nitro group, an alkoxy group such as a methoxy group or a ethoxy group and a —$COOR_{11}$ group wherein $R_{11}$ represents a hydrogen atom, a substituted or an unsubstituted methyl group, an alkyl group such as an ethyl group, a substituted or an unsubstituted benzyl group, an aralkyl group such as a phenethyl group, a substituted or an unsubstituted phenyl group and an aryl group such as a naphtyl group, or a —$CONR_{12}R_{13}$ wherein $R_{12}$ and $R_{13}$ independently represent a hydrogen atom, a substituted or an unsubstituted methyl group, analkyl group such as an ethyl group, a substituted or an unsubstituted benzyl group, a naphthylmethyl group, an aralkyl group such as a phenethyl group, a substituted or an unsubstituted phenyl group and an aryl group such as a naphtyl group; $X_2$ represents a substituted or an unsubstituted phenylene group, an arylene group such as a naphthylene group, a substituted or an unsubstituted alkenylene group, a-CO-group, a-COO-group, a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group; and at least either Y or $X_2$ is an oxycarbonyl group.

Specific examples of the substituents include α-acryloyloxy chloride groups, methacryloyloxy groups, α-cyanoethylene groups, a-cyanoacryloyloxy groups, α-cyanophenylene groups, methacryloylamino groups, etc. Specific examples of further substituents for the substituents of $X_1$, $X_2$ and Y include halogen atoms, nitro groups, cyano groups, methyl groups, alkyl groups such as ethyl groups, methoxy groups, alkoxy groups such as ethoxy groups, aryloxy groups such as phenoxy groups, phenyl groups, aryl groups such as naphthyl groups, benzyl groups, aralkyl groups such as phenethyl groups. Among these radical polymerizing functional groups, the acryloyloxy groups and methacryloyloxy groups are effectively used. A compound having three or more acryloyloxy groups can be formed by, e.g., performing an ester reaction or an ester exchange reaction among a compound having three or more hydroxyl groups, an acrylic acid (salt), halide acrylate and ester acrylate. A compound having three or more methacryloyloxy groups can be formed by the same method. The radical polymerizing functional groups in a monomer having three or more radical polymerizing functional groups may be the same or different from one another.

Specific examples of the radical polymerizing monomer having three or more radical polymerizing groups include, but are not limited to, the following materials. Namely, trimethylolpropanetriacrylate (TMPTA), trimethylolpropanetrimethacrylate, HPA-modified trimethylolpropanetriacrylate, EO-modified trimethylolpropanetriacrylate, PO-modified trimethylolpropanetriacrylate, caprolactone-modified trimethylolpropanetriacrylate, HPA-modified trimethylolpropanetrimethacrylate, pentaerythritoltriacrylate, pentaerythritoltetraacrylate (PETTA), glyceroltriacrylate, ECH-modified glyceroltriacrylate, EO-modified glyceroltriacrylate, PO-modified glyceroltriacrylate, tris(acryloxyethyl)isocyanurate, dipentaerythritolhexaacrylate (DPHA), caprolactone-modified dipentaerythritolhexaacrylate, dipentaerythritolhydroxypentaacrylate, alkyl-modified dipentaerythritolpentaacrylate, alkyl-modified dipentaerythritoltetraacrylate, alkyl-modified dipentaerythritoltriacrylate, dimethylolpropanetetraacrylate (DTMPTA), pentaerythritolethoxytetraacrylate, 2,2,5,5-tetrahydroxymethylcyclopentanonetetraacrylate, etc. are available. These can be used alone or in combination.

The radical polymerizing monomer having three or more radical polymerizing groups for use in the present invention preferably has a ratio of the molecular weight to the number of functional groups (molecular weight/number of functional groups) in the monomer not greater than 250. When the ratio is greater than 250, the resultant crosslinked material has a rather lowered abrasion resistance, and it is not preferable to use the HPA, EO and PO-modified monomers having extremely long modified groups. The crosslinked material preferably includes the radical polymerizing monomer having three or more radical polymerizing groups in an amount of from 20 to 80% by weight, and more preferably from 30 to 70% by weight. When less than 20% by weight, a three-dimensional crosslinking density of the crosslinked material is insufficient, and the abrasion resistance thereof does not remarkably improve more than a material including a conventional thermoplastic resin. When greater than80% by weight, a content of a charge transporting compound lowers and electrical properties of the resultant photoreceptor deteriorates. Although it depends on a required abrasion resistance and electrical properties, in consideration of a balance therebetween, a content of the r radical polymerizing monomer having three or more radical polymerizing groups is most preferably from 30 to 70% by weight based on total weight of the crosslinked material.

Ester Acrylate Compound B Having the Formula (1)

$Ar_1$ represents a substituted or an unsubstituted monovalent group or bivalent group formed of an aromatic hydrocarbon skeleton. Specific examples of the monovalent group or bivalent group formed of an aromatic hydrocarbon skeleton include monovalent or bivalent groups such as benzene, naphthalene, phenanthrene, biphenyl and 1,2,3,4-tetrahydronaphthalene.

Specific examples of substituents of the aromatic hydrocarbon skeleton include an alkyl group having 1 to 12 carbon atoms, an alkoxy group having 1 to 12 carbon atoms, a benzyl group and a halogen atom. The alkyl group and alkoxy group may further have a halogen atom or a phenyl group as a substituent.

$Ar_2$ represents a monovalent group or a bivalent group formed of an aromatic hydrocarbon skeleton or heterocyclic compound skeleton having one or more tertiary amino group. The aromatic hydrocarbon skeleton having an amino group has the following formula:

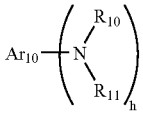

wherein $R_{10}$ and $R_{11}$ represent an acyl group, a substituted or an unsubstituted alkyl group, a substituted or an unsubstituted aryl group or a substituted or an unsubstituted alkenyl group; $Ar_{10}$ represents an aryl group; and h represents an integer of from 1 to 3. Specific examples of the acyl group include an acetyl group, a propionyl group, benzoyl group, etc. Specific examples of the substituted or unsubstituted alkyl group include an alkyl group having 1 to 12 carbon atoms. Specific examples of the substituted or unsubstituted aryl group include a phenyl group, a naphthyl group, a biphenylyl group, a terphenylyl group, pyrenyl group, a fluorenyl group, 9,9-dimethyl-fluorenyl group, azulenyl group, an anthryl group, a triphenylenyl group, a chrysenyl group and groups having the following formulae:

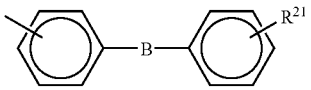

wherein B represents —O—, —S—, —SO—, —$SO_2$—, —CO— and the following bivalent groups; and R represents a hydrogen atom, an alkyl group having 1 to 12 carbon atoms, an alkoxy group, a halogen atom, the above-mentioned substituted or unsubstituted aryl groups, an amino group, a nitro group and a cyano group;

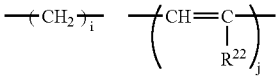

wherein $R^{22}$ represents a hydrogen atom, an alkyl group having 1 to 12 carbon atoms and the above-mentioned substituted or unsubstituted aryl groups; i represents an integer of from 1 to 12; and j represents an integer of from 1 to 3.

Specific examples of the alkoxy group include a methoxy group, an ethoxy group, a n-propoxy group, an i-propoxy group, a n-butoxy group, an i-butoxy group, a s-butoxy group, a t-butoxy group, a 2-hydroxyethoxy group, 2-cyanoethoxy group, abenzyloxy group, a 4-methylbenzyloxy group, a trifluoromethoxy group, etc.

Specific examples of the halogen atom include a fluorine atom, a chlorine atom, a bromine atom and an iodine atom.

Specific examples of the amino group include a diphenylamino group, aditolylamino group, adibenzylamino group, a 4-methylbenzyl group, etc.

Specific examples of the aryl group include a phenyl group, a naphthyl group, a biphenylyl group, a terphenylyl group, pyrenyl group, a fluorenyl group, 9,9-dimethyl-fluorenyl group, azulenyl group, an anthryl group, a triphenylenyl group and a chrysenyl group.

$Ar_{10}$, $R_{10}$ and $R_{11}$ may have an alkyl group having 1 to 12 carbon atoms, an alkoxy group and a halogen atom as a substituent.

Specific examples of the heterocyclic compound skeleton having one or more tertiary amino group include heterocyclic compounds having an amine structure such as pyrrole, pyrazole, imidazole, triazole, dioxazole, indole, isoindole, indoline, benzimidazole, benzotriazole, benzoisoxadine, carbazole and phenoxadine. These may have an alkyl group having 1 to 12 carbon atoms, an alkoxy group and a halogen atom as a substituent.

At least $B_1$ or $B_2$ is a hydrogen atom, and the other is an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group.

The eater acrylate compound B is preferably a compound having the following formula (2):

(2)

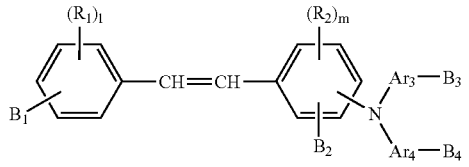

wherein $R_1$ and $R_2$ represent a substituted or an unsubstituted alkyl group, a substituted or an unsubstituted alkoxy group and a halogen atom; and $Ar_3$ and $Ar_4$ represent a substituted or an unsubstituted aryl group or arylene group, and a substituted or an unsubstituted benzyl group; $B_1$ to $B_4$ are the same groups as $B_1$ and $B_2$ in the formula (1), and only one of them is present; 1 represents 0 or an integer of from 1 to 5; and m represents 0 or an integer of from 1 to 4.

The eater acrylate compound B is more preferably a compound having the following formula (3):

(3)

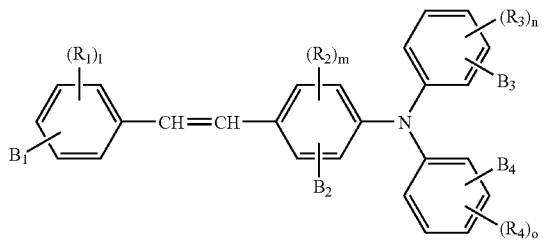

wherein $R_1$ to $R_4$ are the same groups as $R_1$ and $R_2$ in the formula (2); $B_1$ to $B_4$ are the same groups as $B_1$ to $B_4$ therein; 1, n and o represent 0 or an integer of from 1 to 5; and m represents 0 or an integer of from 1 to 4.

Specific examples of the photo polymerization initiators C include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-l-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxi de, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone. These polymerization initiators can be used alone or in combination. The surface layer of the present invention preferably includes the polymerization initiators in an amount of 0.5 to 40 parts by weight, and more preferably from 1 to 20 parts by weight per 100 parts by weight of the radical polymerizing compounds.

Next, a method of forming a layer including the crosslinked material will be explained.

A layer including the crosslinked material of the present invention is formed by preparing a coating liquid including at least the constituents A, B and C; coating the coating liquid on the surface of a photoreceptor; and irradiating the surface thereof with light in compliance with an absorption wavelength of the photo polymerization initiator C to polymerize the constituents A and B.

The coating liquid can include other components when the radical polymerizing monomer is a liquid, and is optionally diluted with a solvent and coated. Specific examples of the solvent include alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and cello solves such as methyl cellosolve, ethyl cellosolve and cellosolve acetate. These solvents can be used alone or in combination. A dilution ratio with the solvent can optionally be decided upon solubility of the compositions, a coating method and a purposed layer thickness. The crosslinked surface layer can be coated by a dip coating method, a spray coating method, a bead coating method, a ring coating method, etc.

The constituent B is required to impart charge transportability to the resultant crosslinked material, and is preferably included therein in an amount of from 20 to 80% by weight, and more preferably from 30 to 70% by weight. When less than 20% by weight, the crosslinked material has insufficient charge transportability, resulting in deterioration of electrical properties such as lowering sensitivity and increase of residual potential. When greater than 80% by weight, the content of the constituent A decreases, resulting in deterioration of crosslinking density.

Besides the constituents A, B and C, the coating liquid can include a radical polymerizing monomer and a radical polymerizing oligomer having one or two functional groups as well to control a viscosity of the surface layer when coated, reduce a stress of thereof, impart a low surface free energy thereto and reduce friction coefficient thereof. Known radical polymerizing monomers and oligomers can be used. Specific examples of the radical monomer having one functional group include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc. Specific examples of the radical monomer having two functional groups include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc. Specific examples of the functional monomers include octafluoropentylacrylate, 2-perfluorooctylethylacrylate, 2-perfluorooctylethylmethacrylate, 2-perfluoroisononylethylacrylate, etc., wherein a fluorine atom is substituted; vinyl monomers having a polysiloxane group having a siloxane repeat unit of from 20 to 70, such as acryloylpolydimethylsiloxaneethyl, methacryloylpolydimethylsiloxaneethyl, acryloylpolydimethylsiloxanepropyl, acryloylpolydimethylsiloxanebutyl and diacryloylpolydimethylsiloxanediethyl; acrylate; and methacrylate. Specific examples of the radical polymerizing oligomer includes epoxyacrylate oligomers, urethaneacrylate oligomers and polyetseracrylate oligomers. However, when the crosslinked surface layer includes a large amount of the radical polymerizing monomer and radical polymerizing oligomer having one or two functional groups, the three-dimensional crosslinked bonding density thereof substantially deteriorates, resulting in deterioration of the abrasion resistance thereof. Therefore, the surface layer of the present invention preferably includes the monomers and oligomers in an amount not greater than 50 parts by weight, and more preferably not greater than 30 parts by weight per 100 parts by weight of the radical polymerizing monomer having three or more functional groups.

Further, the coating liquid may optionally include various additives such as plasticizers (to soften a stress and improve adhesiveness thereof), leveling agents and low-molecular-weight charge transport materials without a radical reactivity. Known additives can be used, and specific examples of the plasticizers include plasticizers such as dibutylphthalate and dioctylphthalate used in typical resins. A content thereof is preferably not greater than 20% by weight, and more preferably not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. A content thereof is preferably not greater than 3% by weight.

After the coating liquid is coated, the coating liquid is irradiated to be hardened optionally after dried. Specific examples of the irradiators include UV irradiators such as high pressure mercury lamps and metal halide lamps having an emission wavelength of UV light; and a visible light source adaptable to absorption wavelength of the radical polymerizing compounds and photo polymerization initiators. An irradiation light amount is preferably from 50 to 2,000 mW/cm$^2$. When less than 50 mW/cm$^2$, the crosslinking reaction takes time. When greater than 2,000 mW/cm$^2$, the crosslinked layer has a local wrinkle on the surface and a large inner stress causing a crack and peeling of the layer.

When irradiated, nitrogen may substitute oxygen preventing the polymerization.

The coating liquid may continuously be irradiated or intermittently be irradiated for plural times.

An electron irradiation which does not need a photo polymerization initiator can also be used for irradiating the coating liquid. However, the light energy is preferably used because it is easy to control the reaction speed therewith.

The more irradiated, the crosslinked material has a higher gel fraction, and becomes more insoluble and un meltable. The gel fraction is preferably not less than 95% in the present invention. The gel fraction can be determined by the following formula, measuring a weight loss of the crosslinked material after dipped in an organic solvent having high solubility, such as tetrahydrofuran, for 5 days.

Gel fraction (%)=weight of crosslinked material after dipped and dried/initial weight thereof×100

The crosslinked material is preferably irradiated such that an accumulated irradiation energy becomes not less than 10 J/cm$^2$to have a gel fraction not less than 95%. The crosslinked material more preferably has a gel fraction not less than 97% to further prevent an inorganic material such as silica from sticking therein. The accumulated irradiation energy is preferably 20 J/cm$^2$ such that the crosslinked material has a gel fraction not less than 97%.

The crosslinked material of the present invention needs incomparably a larger amount of light energy than conventional light-hardening resins because the ester acrylate compound or vinyl compound has a large light absorbability and prevents the cleavage of the photo polymerization initiator. However, in the present invention, this large light absorbability is considered to have an influence on the participation of the double-bonding of the stilbene conjugation structure in the crosslinking reaction.

The crosslinked material is annealed at from 80 to 150° C. for 1 to 60 min after irradiated and hardened to prepare a final electrophotographic photoreceptor.

The electrophotographic photoreceptor of the present invention has the crosslinked material on the surface thereof, and a constitution thereof is not particularly limited. However, the crosslinked material is preferably formed on the surface of an organic photoreceptor to negatively be charged because the constituent b has hole transportability.

The negatively-charged organic photoreceptor typically includes an electro conductive substrate, a charge generation layer thereon and a charge transport layer on the charge generation layer. The charge transport layer can include the crosslinked material. However, a crosslinked charge transport layer including the crosslinked material is preferably formed further on the charge transport layer because the thickness of the charge transport layer is limited due to the hardening conditions when including the crosslinked material.

FIG. 1 is a cross-sectional view of an embodiment of coated layers of the electrophotographic photoreceptor of the present invention, wherein a photosensitive layer 33 on an electroconductive substrate 31 includes a charge-generatable charge generation layer 35, a charge-transportable charge transport layer 37 thereon and a crosslinked charge transport layer 39 on the charge transport layer 37.

Suitable materials for use as the electroconductive substrate 31 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinumandthe like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the electroconductive substrate 31. Besides, substrates, in which a coating liquid including a binder resin and an electroconductive powder is coated on the supporters mentioned above, can be used as the electroconductive substrate of the present invention.

Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

Further, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be preferably used as the electroconductive substrate of the present invention.

Next, the photosensitive layer will be explained.

The charge transport layer (CGL) 35 is mainly formed of a charge generation material, and optionally includes a binder resin. Suitable charge generation materials include inorganic materials and organic materials. Specific examples of the inorganic charge generation materials include crystalline selenium, amorphous selenium, selenium-tellurium alloys, selenium-tellurium-halogen alloys and selenium-arsenic alloys. Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azopigmentshavinga fluorenone skeleton, azopigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge transport materials can be used alone or in combination.

Specific examples of the binder resin optionally used in the CGL 35 include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. In addition, a charge transport polymer material can also be used as the binder resin in the CGL besides the above-mentioned binder resins. Specific examples thereof include polymer materials such as polycarbonate resins, polyester resins, polyurethane resins, polyether resins, polysiloxane resins and acrylicresinshavinganarylamineskeleton, abenzidineskeleton, ahydrazone skeleton, acarbazole skeleton, a stilbene skeleton, a pyrazoline skeleton, etc.; and polymer materials having polysilane skeleton.

Specific examples of the former polymer materials include charge transport polymer materials disclosed in Japanese Laid-Open Patent Publications Nos. 01-001728, 01-009964, 01-013061, 01-019049, 01-241559, 04-011627, 04-175337, 04-183719, 04-225014, 04-230767, 04-320420, 05-232727, 05-310904, 06-234838, 06-234839, 06-234840, 06-234839, 06-234840, 06-234841, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc.

Specific examples of the latter polymer materials include polysilylene polymers disclosed in Japanese Laid-Open Patent Publications Nos. 63-285552, 05-19497, 05-70595, 10-73944, etc.

The CGL 35 also can include a low-molecular-weight charge transport material. The low-molecular-weight charge transport materials include positive hole transport materials and electron transport materials. Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b] thiophene-4-one, 1,3,7-trinitrobenzothiophene-5,5-dioxide, diphenoquinone derivatives, etc. These electron transport materials can be used alone or in combination.

Specific examples of the positive hole transport materials include electron donatingmaterials such as oxazole derivatives, oxadiazole derivatives, imidazole derivatives, monoarylamines derivatives, diarylaminederivatives, triarylaminederivatives, stilbenederivatives, α-phenylstilbenederivatives, benzidine derivatives, diarylmethane derivatives, triarylmethane derivatives, 9-styrylanthracene derivatives, pyrazoline derivatives, divinylbenzenederivatives, hydrazonederivatives, indene derivatives, butadiene derivatives, pyrene derivatives, bisstilbene derivatives, enamine derivatives, and other known materials. These positive hole transport materials can be used alone or in combination.

Suitable methods for forming the charge generation layer 35 are broadly classified into a vacuum thin film forming method and a solvent dispersion casting method. Specific examples of the former vacuum thin film forming method include a vacuum evaporation method, a glow discharge decomposition method, an ion plating method, a sputtering method, a reaction sputtering method, CVD (chemical vapor deposition) methods, etc. A layer of the above-mentioned inorganic and organic materials can be formed by these methods. The casting method for forming the charge generation layer typically includes preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc., optionally with a binder resin and a leveling agent such as a dimethylsilicone oil and methylphenyl silicone oil, and then dispersing the materials with a ball mill, an attritor, a sand mill, beads mill, etc. to prepare a CGL coating liquid; coating the CGL coating liquid, which is diluted if necessary, on a substrate by a method such as dip coating, spray coating, bead coating and ring coating; and drying the coated liquid to form a CGL. The thickness of the CGL is preferably from about 0.01 to about 5 μm, and more preferably from about 0.05 to about 2 μm.

The charge transport layer (CTL) 37 is a charge-transportable layer, and is formed on the CGL 35 by dissolving or dispersing a charge-transportable charge transport material and a binder resin in a proper solvent to prepare a coating liquid; and coating and drying the liquid on the CGL. Specific examples of the charge transport materials include electron transport materials, positive hole transport materials and charge transport polymer materials used in the CGL. Particularly, the charge transport polymer materials are effectively used to reduce a solution of the CTL 37 when the crosslinked CTL 39 is coated thereon.

Specific examples of the binder resins include thermoplastic or thermosetting resins such as polystyrene, styrene-acrylonitrile copolymers, styrene-butadiene copolymers, styrene-maleic anhydride copolymers, polyester, polyvinylchloride, vinylchloride-vinylacetate copolymers, polyvinylacetate, polyvinylidenechloride, polyarylate resins, phenoxy resins, polycarbonate, cellulose acetate resins, ethylcellulose resins, polyvinylbutyral, polyvinylformal, polyvinyltoluene, poly-N-vinylcarbazole, acrylic resins, silicone resins, epoxy resins, melamine resins, urethane resins, phenol resins and alkyd resins.

The CTL preferably include the charge transport material in an amount of from 20 to 300 parts by weight, and more preferably from 40 to 150 parts by weight per 100 parts by weight of the binder resin. However, the charge transport polymer material can be used alone or in combination with the binder resin. Specific examples of a solvent used for coating the CTL 37 include the solvents used for coating the CGL 35, and particularly the solvents solving the charge transport material and binder resin well are preferably used.

These solvents can be used alone or in combination. The CTL 37 can be formed by the same coating methods used for coating the CGL 35.

In addition, the CTL 37 ay optionally include a plasticizer and a leveling agent. Specific examples of the plasticizers include plasticizers for typical resins, such as dibutylphthalate and dioctylphthalate, and a content thereof is preferably from 0 to 30 parts by weight per 100 parts by weight of the binder resin. Specific examples of the leveling agents include silicone oil such as dimethyl silicone oil and methylphenyl silicone oil; and polymers or oligomers having a perfluoroalkyl group in the side chain, and a content thereof is preferably from 0 to 1 part by weight per 100 parts by weight of the binder resin. The CTL 37 preferably has a thickness of from 5 to 40 μm, and more preferably from 10 to 30 μm.

The above-mentioned coating liquid including the constituents A, B and C of the present invention is coated on the CTL 37 to form the crosslinked CTL 39 thereon.

The photoreceptor of the present invention can have an intermediate layer between the CTL 37 and the crosslinked CTL 39. The intermediate layer prevents components of the lower CTL 37 from mixing in the crosslinked CTL 39 and improves the adhesiveness therebetween. Therefore, the intermediate layer is preferably insoluble or hardly-soluble with the crosslinked CTL coating liquid and typically includes a binder resin as a main component. Specific examples of the resin include polyamides, alcohol-soluble nylons, water-soluble polyvinyl butyral, polyvinyl butyral, polyvinyl alcohol, etc. The intermediate layer can be formed by one of the above-mentioned known coating methods. The intermediate layer preferably has a thickness of from 0.05 to 2 μm.

The photoreceptor of the present invention may have an undercoat between the electroconductive substrate 31 and the photosensitive layer 33. The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moire in the recorded images and to decrease residual potential of the photoreceptor. The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, known materials can be used. The thickness of the undercoat layer is preferably from 0 to 5 μm.

In the present invention, an antioxidant can be included in each of the layers, i.e., the crosslinked surface layer, charge generation layer, charge transport layer, undercoat layer and intermediate layer to improve the stability to withstand environmental conditions, namely to avoid decrease of photosensitivity and increase of residual potential.

Specific examples of the antioxidant for use in the present invention include the following compound.

(a) Phenolic Compounds 2,6-di-t-butyl-p-cresol, butylated hydroxyanisole, 2,6-di-t-butyl-4-ethylphenol, n-octadecyl-3-(4'-hydroxy-3', 5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris (3,5-di-t-butyl-4-hydroxybenzyl)benzene, tetrakis-[methylene-3-(3'5'-di-t-butyl-4'-hydroxyphenyl)propionate]methane, bis [3,3'-bis (4'-hydroxy-3'-t-butylphenyl)butyric acid]glycol ester, tocophenol compounds, etc.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur-Containing Compounds

Dilauryl-3,3'-thiodipropionate, distearyl-3,3'-thiodipropionate, ditetradecyl-3,3'-thiodipropionate, etc.

(e) Organic Phosphorus-Containing Compounds

Triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats, etc., and marketed products thereof can easily be obtained. Each of the layers preferably includes the antioxidant in an amount of from 0.01 to 10% by weight based on total weight thereof.

The crosslinked CTL 39 (=a layer including a crosslinked material) of the present invention preferably has a thickness of from 1 to 20 μm, and more preferably from 3 to 15 μm. When thicker than 20 μm, the crosslinked CTL is liable to be cracked or peeled, and difficult to have a high crosslinking density because the photo polymerization initiator is difficult to initiate the radical polymerization in the depth. The radical polymerization is liable to be impaired with oxygen, and the surface contacting the atmospheric air is not crosslinked well or nonuniformly crosslinked due to the oxygen radical trap. This frequently happens when the thickness is less than 1 μm. The charge transport components from the under CTL mix therein, and pervades the crosslinked CTL when thin, resulting in prevention of the polymerization and deterioration of the crosslinking density. Therefore, the crosslinked CTL preferably has a thickness not less than 1 μm, and more preferably not less than 3 μm for a longer life of the resultant photoreceptor.

Next, the image forming method and image forming apparatus of the present invention will be explained in detail, referring to the drawings.

The image forming method and image forming apparatus of the present invention include a multilayered photoreceptor having a highly abrasion resistant and damage resistant crosslinked CTL being difficult to be cracked and peeled, wherein the photoreceptor is charged-and irradiated with imagewise light to form an electrostatic latent image thereon; the electrostatic. latent image is developed to form a toner image; the toner image is transferred onto an image bearer (transfer sheet) and fixed thereon; and a surface of the photoreceptor is cleaned. The process is not limited thereto in such a method as to directly transfer an electrostatic latent image onto a transfer sheet and develop the electrostatic latent image thereon.

Figure 2:
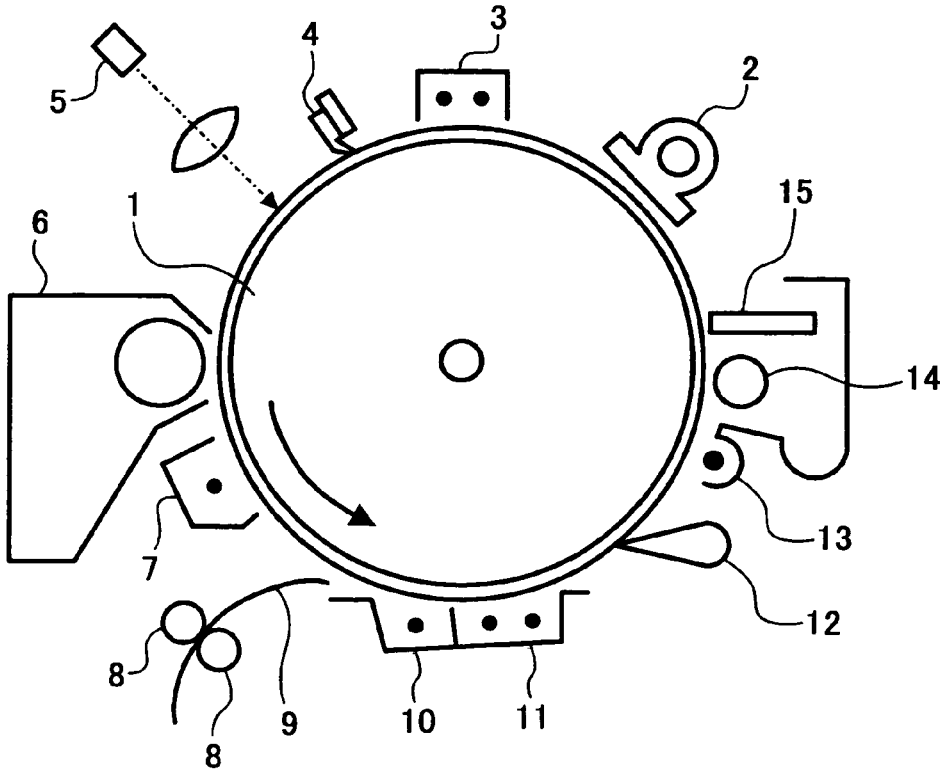
FIG. 2 is a schematic view illustrating a partial cross-section of an embodiment of the image forming apparatus of the present invention.

FIG. 2 is a schematic view illustrating a partial cross-section of an embodiment of the image forming apparatus of the present invention. A charger 3 is used to uniformly charge a photoreceptor 1. Specific examples of the charger include known chargers such as corotron devices, scorotron device, solid state chargers, needle electrode devices, roller charging devices and electroconductive brush devices. Contact chargers or non-contact chargers can be used in the present invention. The contact chargers include a charging roller, a charging brush, a charging blade, etc. directly contacting a photoreceptor. The non-contact chargers include, e.g., a charging roller located close to a photoreceptor with a gap not longer than 200 μm therebetween. When the gap is too long, the photoreceptor is not stably charged. When too short, the charging member, e.g., a charging roller is contaminated with a toner remaining on the photoreceptor. Therefore, the gap preferably has a length of from 10 to 200 μm, and more preferably from 10 to 100 μm.

Next, an imagewise irradiator 5 is used to form an electrostatic latent image on the photoreceptor 1. Suitable light sources thereof include typical light emitters such as fluorescent lamps, tungsten lamps, halogen lamps, mercurylamps, sodium lamps, light emitting diodes (LEDs), laser diodes (LDs), light sources using electroluminescence (EL), etc. In addition, to obtain light having a desired wave length range, filters such as sharp-cut filters, band pass filters, near-infrared cutting filters, dichroic filters, interference filters and color temperature converting filters can be used.

Next, a developing unit 6 is used to visualize an electrostatic latent image formed on the photoreceptor 1. The developing methods include a one-component developing method and a two-component developing method using a dry toner; and a wet developing method using a wet toner. When the photoreceptor positively or negatively charged is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image can be obtained.

Next, a transfer charger 10 is used to transfer a toner image visualized on the photoreceptor onto a transfer sheet 9. A pre-transfer charger 7 may be used to perform the transfer better. Suitable transferers include a transferer charger, an electrostatic transferer using a bias roller, an adhesion transferer, a mechanical transferer using a pressure and a magnetic transferee. The above-mentioned chargers can be used for the electrostatic transferee.

Next, a separation charger 11 and a separation pick 12 are used to separate the transfer sheet 9 from the photoreceptor 1. Other separation means include an electrostatic absorption induction separator, a side-edge belt separator, a tip grip conveyor, a curvature separator, etc. The above-mentioned chargers can be used for the separation charger 11.

Next, a fur brush 14 and a cleaning blade 15 are used to remove a toner left on the photoreceptor after transferred therefrom. A pre-cleaning charger 13 may be used to perform the cleaning more effectively. Other cleaners include a web cleaner, a magnet brush cleaner, etc., and these cleaners can be used alone or in combination. Next, a discharger is optionally used to remove a latent image in the photoreceptor. The discharger includes a discharge lamp 2 and a discharger, and the above-mentioned light sources and chargers can be used respectively. Known means can be used for other an original reading process, a paper feeding process, a fixing process, a paper delivering process, etc.

The above-mentioned image forming unit may be fixedly set in a copier, a facsimile or a printer. However, the image forming unit may be detachably set therein as a process cartridge.

Figure 3:
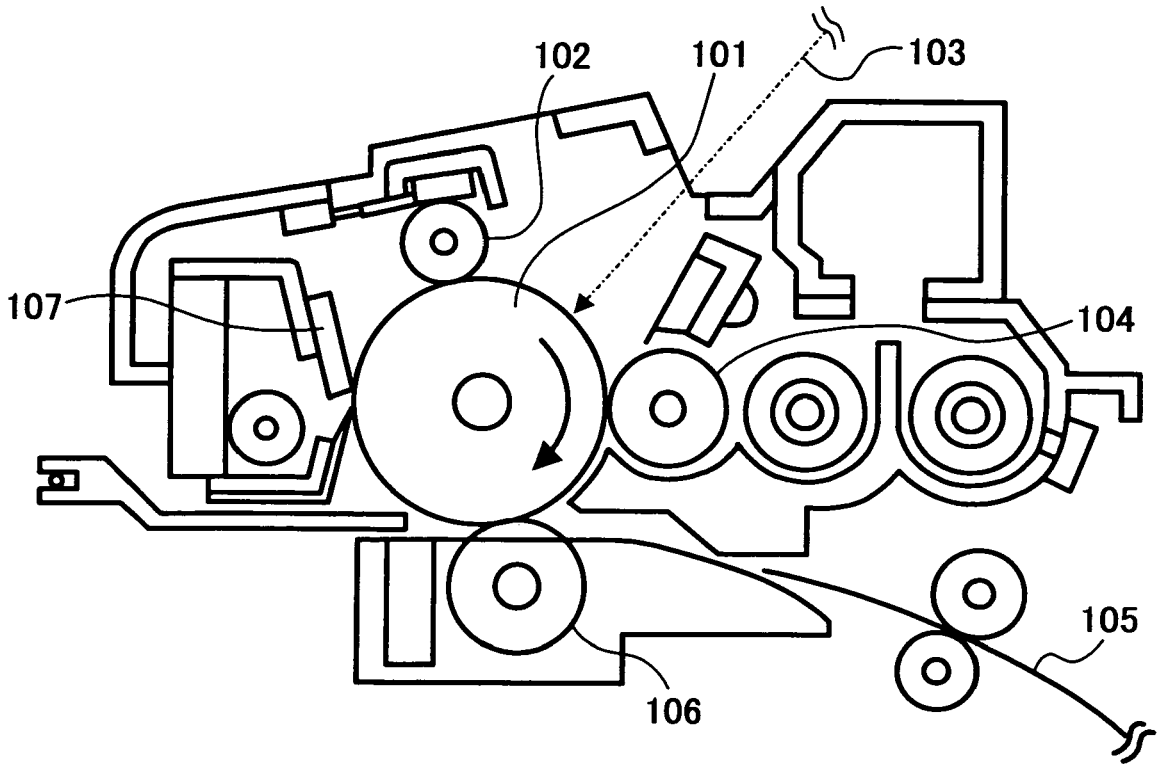
FIG. 3 is a schematic view illustrating a cross-section of an embodiment of the process cartridge for the image forming apparatus of the present invention.

FIG. 3 is a schematic view illustrating a cross-section of an embodiment of the process cartridge for the image forming apparatus of the present invention. The process cartridge is an image forming unit (or device) detachable from an image forming apparatus, including a photoreceptor 101 and at least one of a charger 102, an image developer 104, a transferer 106, a cleaner 107 and a discharger (not shown).

While the photoreceptor 101 rotates in a direction indicated by an arrow, the photoreceptor 101 is charged by the charger 102 and irradiated by an irradiator 103 to form an electrostatic latent image relevant to imagewise light thereon. The electrostatic latent image is developed by the image developer 104 with a toner to form a form a toner image, and the toner image is transferred by the transferer 106 onto a transfer sheet 105 to be printed out. Next, a surface of the photoreceptor after the toner image is transferred is cleaned by the cleaner 107, discharged by a discharger (not shown) and these processes are repeated.

As is apparent from the explanations mentioned above, the electrophotographic photoreceptor of the present invention can widely be used in electrophotography applied fields such as a laser beam printer, a CRT printer, a LED printer, a liquid crystal printer and a laser engraving.

Methods of preparing the compound B for use in the present invention will be explained.

SYNTHESIS EXAMPLE 1

Preparation of Diethyl 2-hydroxybenzylphosphonate 38.4 g of 2-hydroxybenzylalcohol from TOKYO KASEI KOGYO Co., Ltd. and 80 ml of o-xylene were put in a reaction reservoir having a mixer, a thermometer and a dropping funnel. Under a nitrogen stream, 62.8 g of triethylphosphite were slowly dropped therein at 80° C., and the reaction therein is further performed for 1 hr at the same temperature. Then, the produced ethanol, o-xylene and unreacted triethyl phosphite were removed from the reaction by reduced-pressure distillation to prepare 66 g of 2-diethylhydroxybenzylphosphonate at a yield of 90%, having a boiling point of 120.0° C./1.5 mm Hg.

Preparation of 2-hydroxy-4'-(di-para-tolylamino)stilbene 14.8 g of kalium-tert-butoxide and 50 ml of tetrahydrofuran were put in a reaction reservoir having a mixer, a thermometer and a dropping funnel. Under a nitrogen stream, a solution wherein 9.90 g of the diethyl 2-hydroxybenzylphosphonate and 5.44 g of 4-(di-para-tolylamino) benzaldehyde were dissolved in tetrahydrofuran was slowly dropped there in at a room temperature, and the reaction therein is further performed for 2 hrs at the same temperature. Then, water was added therein while cooling the reaction product with water, a hydrochloric acid solution having a normal concentration of 2 was added therein to acidize the reaction product, and the tetrahydrofuran was removed by an evaporator to extract a crude product with toluene. The toluene phase was washed with water, a sodium hydrogen carbonate solution and a saturated saline in this order, and magnesium sulfate was further added thereto to dehydrate the toluene phase. After filtered, the toluene was removed therefrom to prepare an oily crude product, and the oily crude product was further column-refined with silica gel to crystallize 5.09 g of 2-hydroxy-4'-(di-para-tolylamino) stilbene in hexane at a yield of 72%, having a boiling point of 136.0 to 138.0° C.

Preparation of
4'-(di-para-tolylamino)stilbene-2-ylacrylate 14.9 g of the 2-hydroxy-4'-(di-para-tolylamino) stilbene. 100 ml of tetrahydrofuran and 21.5 g of sodium hydrogen carbonate solution having a concentration of 12% were put in a reaction reservoir having a mixer, a thermometer and a dropping funnel. Under a nitrogen stream, 5.17 g of chloride acrylate was dropped therein for 30 min at 5° C., and the reaction therein is further performed for 3 hrs at the same temperature. The reaction liquid was put in water, extracted with toluene, condensed and column-refined with silica gel to prepare a crude product. The crude product was recrystallized with ethanol to prepare 13.5 g of a yellow needle crystal 4'-(di-para-tolylamino)stilbene-2-ylacrylate (Exemplified Compound No. 2) at a yield of 79.8%, having a boiling point of 104.1 to 105.2° C. The elemental analysis thereof is as follows.

Elemental Analysis Value (%)

| | C | H | N |
|---|---|---|---|
| Found value | 83.46 | 6.06 | 3.18 |
| Calculated value | 83.57 | 6.11 | 3.14 |

As mentioned above, an ester 2-hydroxybenzylphosphate derivative and various amino-substituted benzaldehyde derivatives are reacted to synthesize a number of 2-hydroxystilbene derivatives, and the 2-hydroxystilbene derivatives are acrylated or methacrylated to synthesize various ester acrylate compounds.

SYNTHESIS EXAMPLE 2

Preparation of Diethyl 4-methoxybenzylphosphonate 4-methoxybenzylchloride and triethyl phosphite were reacted for 5 hrs at 150° C. Then the excessive triethylphosphite and a by product ethyl chloride were removed by reduced-pressure distillation to prepare diethyl 4-methoxybenzylphosphonate.

(Preparation of
4-methoxy-4'-(di-para-tolylamino)stilbene)

Same mol of the diethyl 4-methoxybenzylphosphonate and 4-(di-para-tolylamino)benzaldehyde were dissolved in N.N-dimethylformamide, and tert-butoxy kalium was gradually added to the solution while water-cooled and stirred. After stirred for 5 hrs at a room temperature, water was added thereto to acidize the solution and a crude product is separated out. The crude product was further column-refined with silica gel to prepare 4-methoxy-4'-(di-para-tolylamino)stilbene.

Preparation of
4-hydroxy-4'-(di-para-tolylamino)stilbene

The 4-methoxy-4'-(di-para-tolylamino)stilbene and a double equivalent weight of sodiumethanethiolate were dissolved in N.N-dimethylformamide and reacted for 5 hrs at 130° C. The solution was cooled and put in water, neutralized with a hydrochloric acid, and a reaction product was extracted with ethylacetate. The extracted liquid was washed with water, dried and a solvent was removed therefrom to prepare a crude product. The crude product was further column-refined with silica gel to prepare 4-hydroxy-4'-(di-para-tolylamino)stilbene.

Preparation of
4'-(di-para-tolylamino)stilbene-4-ylacrylate

The acrylating procedure in Synthesis Example 1 was repeated to prepare 4'-(di-para-tolylamino) stilbene-4-ylacrylate except for using the 4-hydroxy-4'-(di-para-tolylamino) stilbene instead of the 2-hydroxy-4'-(di-para-tolylamino)stilbene.

As mentioned above, an ester 4-hydroxybenzylphosphate derivative and various amino-substituted benzaldehyde derivatives are reacted to synthesize a number of 4-hydroxystilbene derivatives, and the 2-hydroxystilbene derivatives are acrylated or methacrylated to synthesize various ester acrylate compounds.

SYNTHESIS EXAMPLE 3

Preparation of Diethyl 3-methoxybenzylphosphonate

The phosphonating procedure in Synthesis Example 2 was repeated to prepare diethyl 3-methoxybenzylphosphonate except for using 3-methoxybenzylchloride instead of the 4-methoxybenzylchloride.

Preparation of
3-methoxy-4'-(di-para-tolylamino)stilbene

The stilbene-containing procedure in Synthesis Example 2 was repeated to prepare 3-methoxy-4'-(di-para-tolylamino) stilbene except for using the diethyl 3-methoxybenzylphosphonate instead of the diethyl 4-methoxybenzylphosphonate.

Preparation of
3-hydroxy-4'-(di-para-tolylamino)stilbene

The de-methylating procedure in Synthesis Example 2 was repeated to prepare 3-hydroxy-4'-(di-para-tolylamino) stilbene except for using the 3-methoxy-4'-(di-para-tolylamino) stilbene instead of the 4-methoxy-4'-(di-para-tolylamino)stilbene.

Preparation of
4'-(di-para-tolylamino)stilbene-3-ylacrylate

The acrylating procedure in Synthesis Example 1 was repeated to prepare 4'-(di-para-tolylamino) stilbene-3-ylacrylate except for using the 3-hydroxy-4'-(di-para-tolylamino) stilbene instead of the 2-hydroxy-4'-(di-para-tolylamino)stilbene.

SYNTHESIS EXAMPLE 4

Preparation of
4-[phenyl(4-styrylphenyl)amino]benzaldehyde 4.63 parts of N,N-dimethylformamide were put in toluene, and 8,83 parts of oxy phosphorous chloride were slowly dropped in the solution while cooled with ice to prepare a Vilsmeier reagent. A toluene solution including 10 parts of 4-N,N-diphneylaminostibene was dropped therein, and reacted therewith for 4 hrs at 80° C. After 18 parts of ethylacetate was added to the reaction liquid and stirred therein after cooled, the reaction liquid was neutralized in water, and a crude product was extracted with ethylacetate. Then, the crude product was further column-refined with silica gel to prepare 5 parts of 4-[phenyl(4-styrylphenyl)amino]benzaldehyde.

Preparation of
4-[phenyl(4-styrylphenyl)amino]benzalcohol 5.4 parts of hydrogenated lithium aluminum were added in tetrahydrofuran while cooled with ice, a tetrahydrofuran solution including 50 parts of the 4-[phenyl(4-styrylphenyl) amino]benzaldehyde was slowly dropped therein, and the reaction therein was performed for 2 hrs at a room temperature. Then, water and an alkaline solution were added to the reaction liquid, and the liquid was filtered and a solvent was removed therefrom to prepare a crude product. The crude product was further recrystallized to prepare 45.2 parts of 4-[phenyl(4-styrylphenyl) amino]benzalcohol having a boiling point of from 107 to 109.5° C.

(Preparation of
4-[phenyl(4-styrylphenyl)amino]benzacrylate)

8 parts of triethylamine were added to a tetrahydrofuran solution including 20 parts of the 4-[phenyl(4-styrylphenyl) amino]benzalcohol, and a tetrahydrofuran solution including 6.7 parts of chloride acrylate was dropped therein, and the reaction therein was performed for 3 hrs at a room temperature. Then, toluene was added therein, and the reaction product was washed with water, and a solvent was removed therefrom to a crude product. The crude product was further column-refined with silica gel to prepare 22 parts of 4-[phenyl (4-styrylphenyl)amino]benzacrylate As mentioned above, Various amino stilbene compounds are formylated, reduced to alcohol, and finally acrylated or methacrylated to synthesize various ester acrylate compounds.

SYNTHESIS EXAMPLE 5

[Preparation of N-(1,1-diphenylethenyl-2-yl)-N-(4'-hydrozy-4-styrylphenyl)a niline]

3.0 parts of N-(1,1-diphenylethenyl-2-yl)-N-(4!-methoxy-4-styrylphenyl)a niline] and 2.6 parts of sodiumethanethiolate were dissolved in 60 ml of N.N-dimethylformamide and reacted for 5 hrs at 135° C. The solution was cooled and put in water, neutralized with a hydrochloric acid, and a reaction product was extracted with ethylacetate. The extracted liquid was washed with water, dried and a solvent was removed therefrom to prepare a crude product. The crude product was further column-refined with silica gel to prepare N-(1,1-diphenylethenyl-2-yl)-N-(4'-hydrozy-4-styrylphenyl) aniline.

[Preparation of N-(1,1-diphenylethenyl-2-yl)-N-(4'-acryloyloxy-4-styrylphen yl)aniline (Exemplified Compound No. 23)]

0.7 parts of triethylamine were added to a tetrahydrofuran solution including 2.0 parts of the N-(1,1-diphenylethenyl-2-yl)-N-(4'-hydrozy-4-styrylphenyl)a niline and a tetrahydrofuran solution including 0.6 g of chloride acrylate was dropped therein, and the reaction therein was performed for 40 min at a room temperature. Then, ethylacetate was added to the reaction product, and the reaction product was washed with water and a solvent was removed therefrom to prepare a crude product. The crude product was further column-refined with silica gel to prepare 1.2 parts of amorphous N-(1,1-diphenylethenyl-2-yl)-N-(4'-acryloyloxy-4-styrylphen yl)aniline.

SYNTHESIS EXAMPLE 6

[Preparation of 1,2,3,3a,4,8b-hexahydro-4-phenyl-7-(4'-hydroxy)styrylcyclopento[b]indole]

6.3 parts of 1,2,3,3a,4,8b-hexahydro-4-phenyl-7-(4'-methoxy)styrylcyclop ento[b]indole and 4.3 parts of sodiumethanethiolate were dissolved in 100 ml of N.N-dimethylformamide, and reacted for 9 hrs at 135° C. The solution was cooled and put in water, neutralized with a hydrochloric acid, and a reaction product was extracted with ethylacetate. The extracted liquid was washed with water, dried and a solvent was removed therefrom to prepare a crude crystal. Further, the crude crystal was recrystallized to prepare 3.2 parts of 1,2,3,3a,4,8b-hexahydro-4-phenyl-7-(4'-hydroxy)styrylcyclopento[b]indole.

[Preparation of 1,2,3,3a,4,8b-hexahydro-4-phenyl-7-(4'-acrylolyoxy)styrylcy clopento[b]indole(Exemplified Compound No. 71)]

1.3 parts of triethylamine were added to a tetrahydrofuran solution including 3.0 parts of the 1,2,3,3a,4,8b-hexahydro-4-phenyl-7-(4'-hydroxy)styrylcyclop ento[b]indole and a tetrahydrofuran solution including 1.5 g of chloride acrylate was dropped therein, and the reaction therein was performed for 30 min at a room temperature. Then, ethylacetate was added to the reaction product, and the reaction product was washed with water and a solvent was removed therefrom to prepare a crude product. The crude product was further column-refined with silica gel to prepare 3.1 parts of yellow crystal 1,2,3,3a,4,8b-hexahydro-4-phenyl-7-(4'-acrylolyoxy)styrylcy clopento[b]indolehavingaboilingpointoffrom132.0to133.5° C.

The followings are exemplified ester acrylate compounds used as the compound B, but are not limited thereto.

No.1

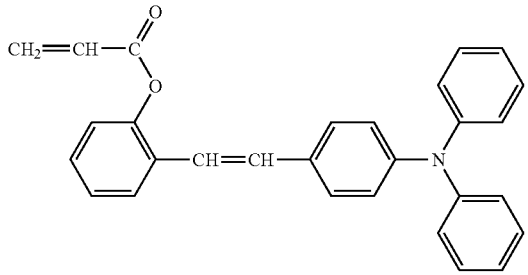

-continued
No.2
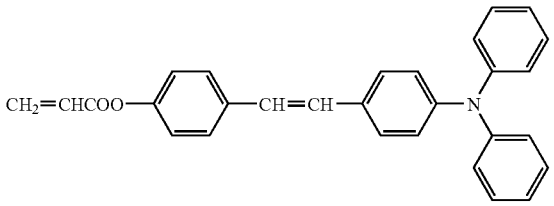
No.3
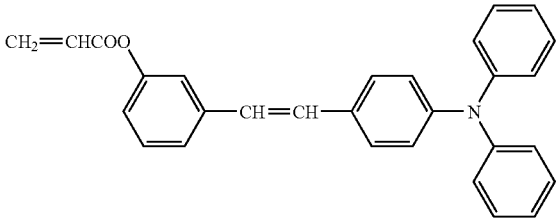
No.4
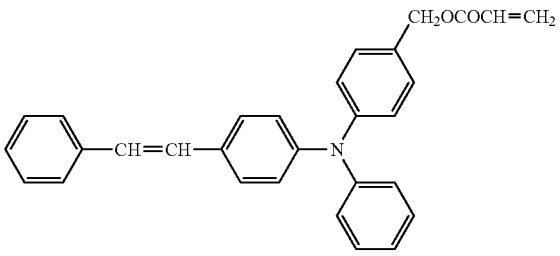
No.5
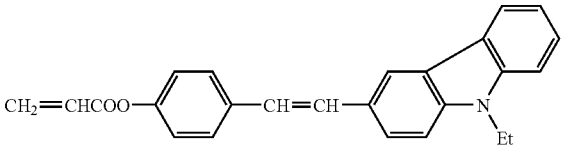
No.6
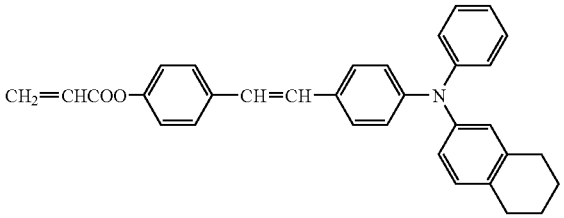
No.7
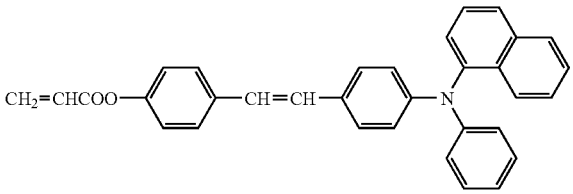
-continued
No.8
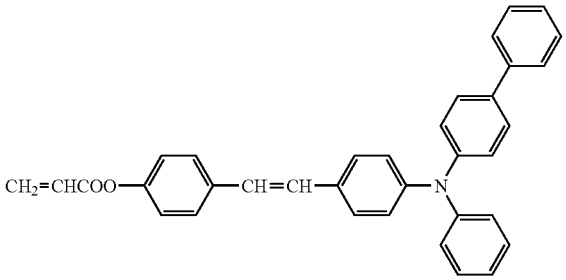
No.9
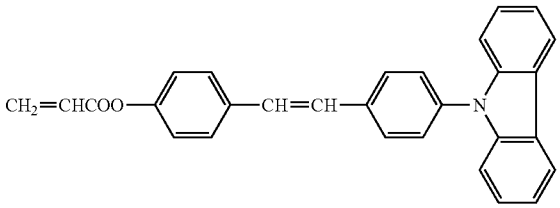
No.10
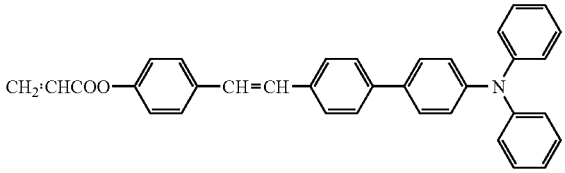
No.11
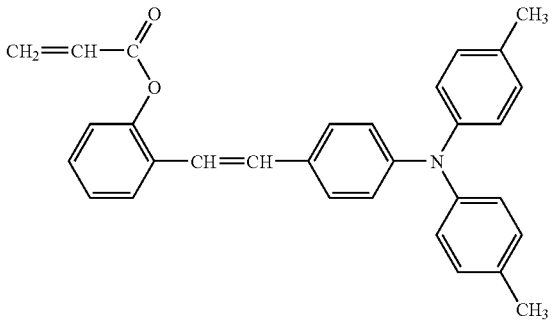
No.12
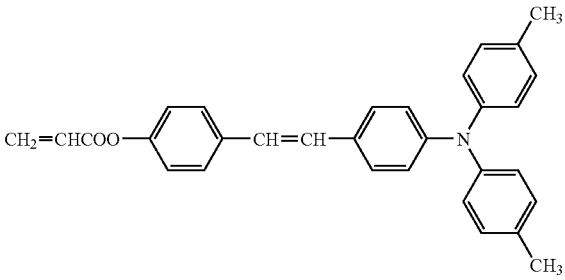

-continued
No.13
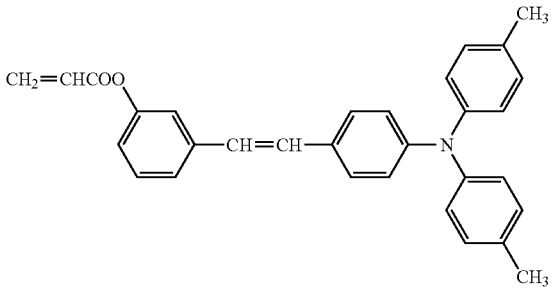
No.14
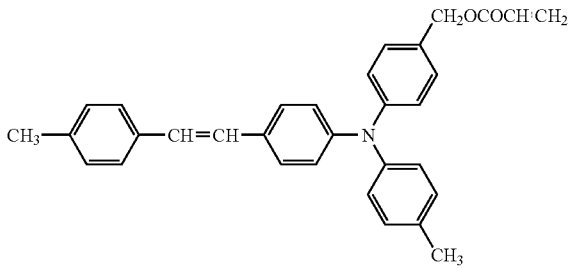
No.15
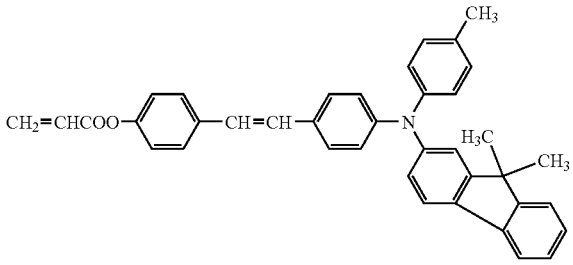
No.16
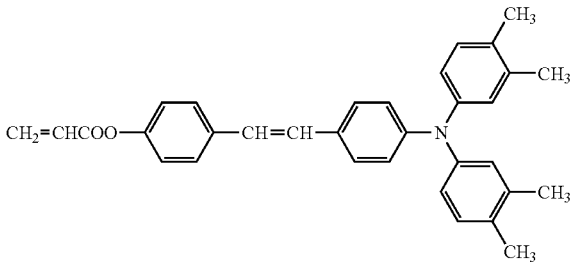
No.17
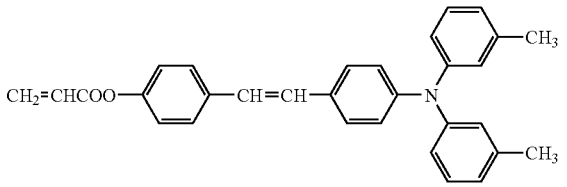
-continued
No.18
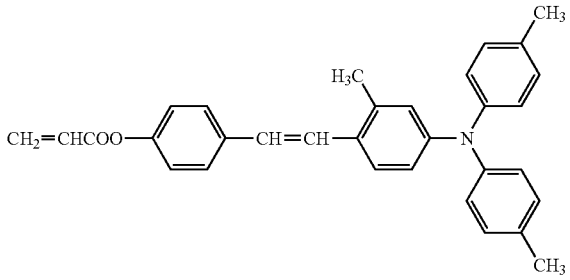
No.19
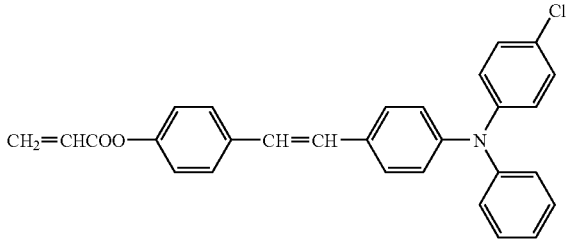
No.20
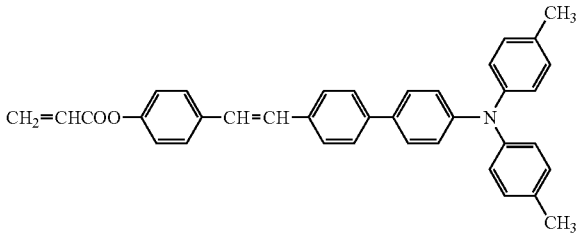
No.21
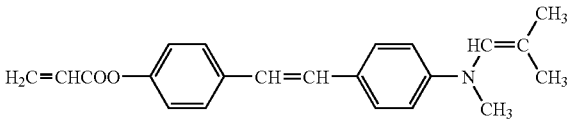
No.22
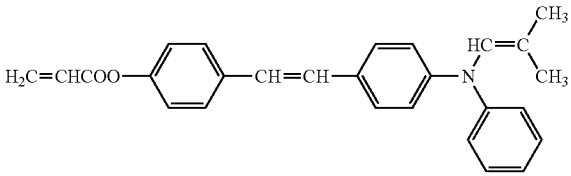
No.23
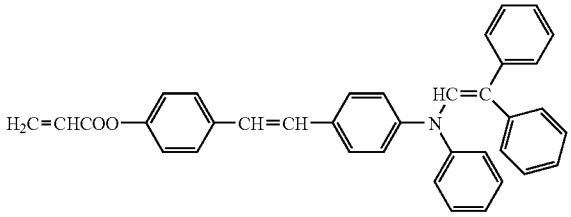

-continued
No.24
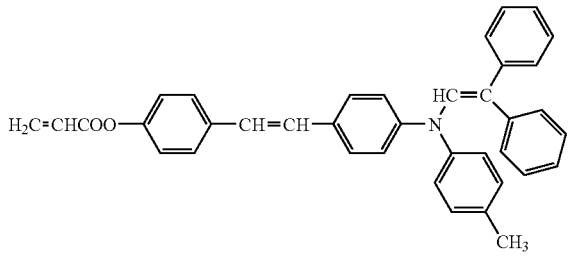
No.25
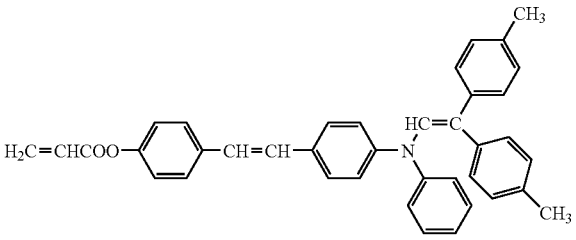
No.26
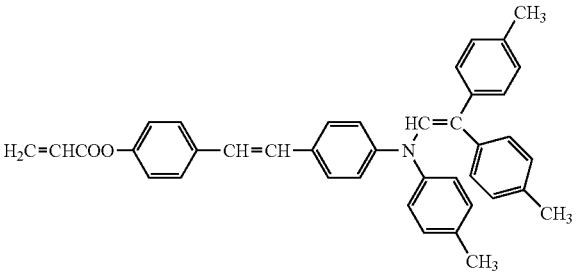
No.27
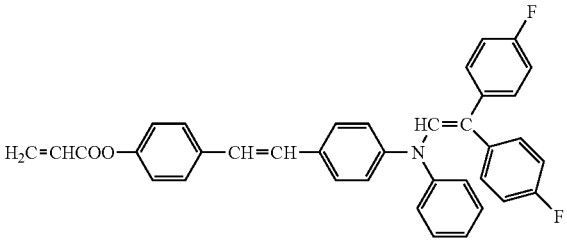
No.28
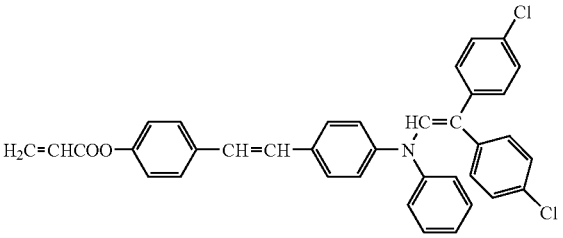
No.29
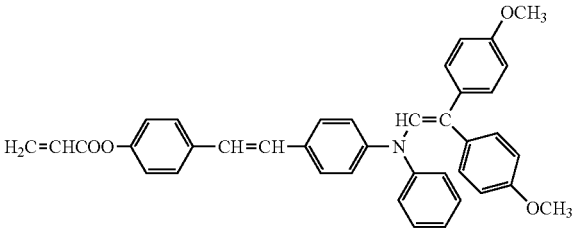
-continued
No.30
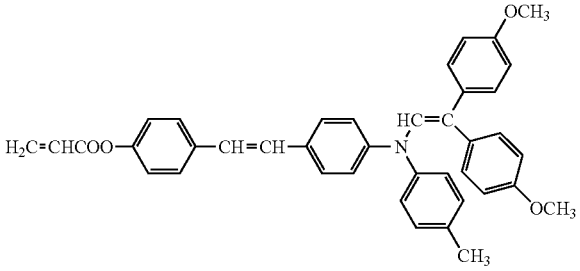
No.31
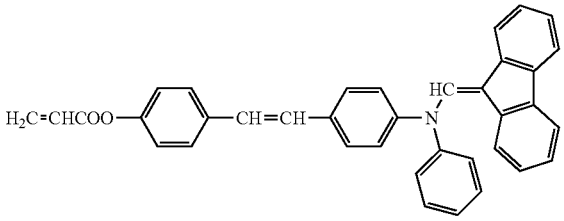
No.32
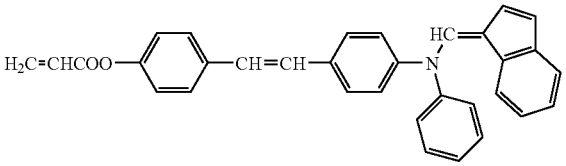
No.33
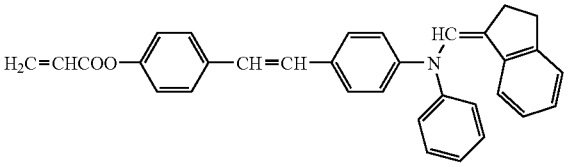
No.34
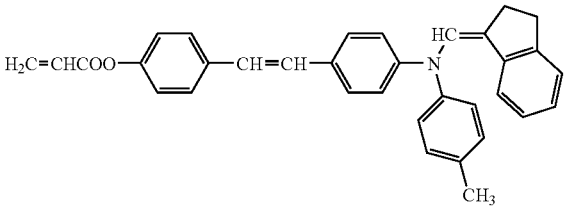
No.35
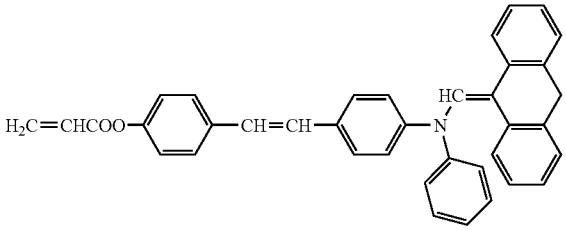
No.36
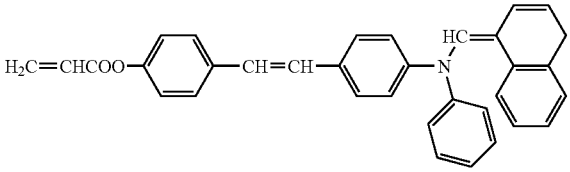

-continued
No.37
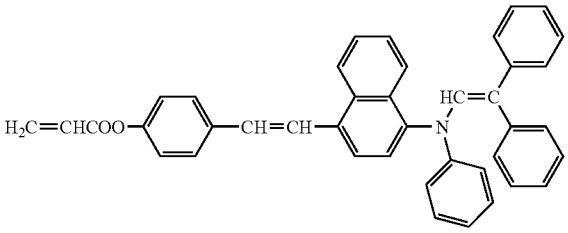
No.38
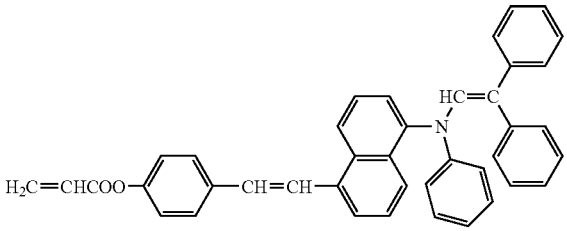
No.39
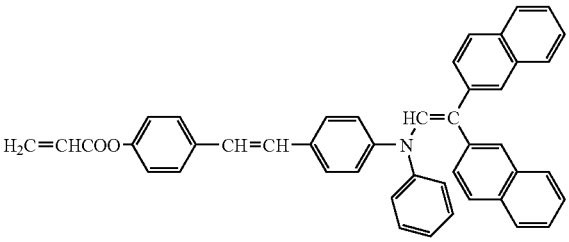
No.40
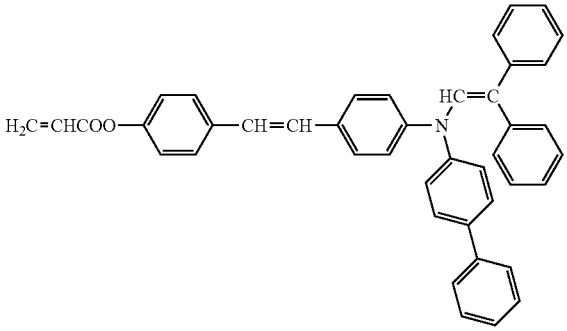
No.41
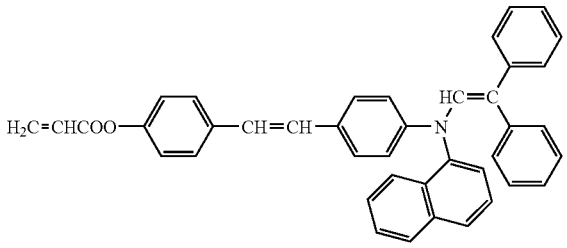
-continued
No.42
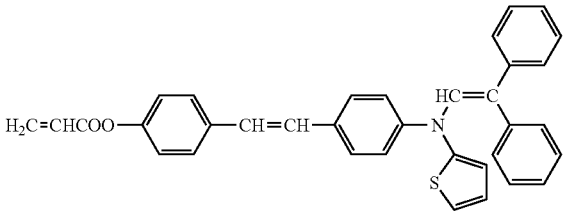
No.43
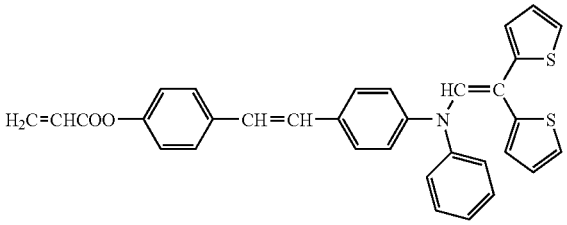
No.44
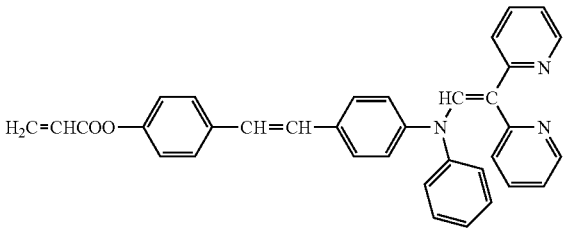
No.45
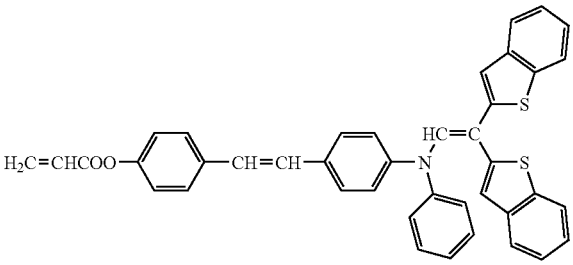
No.46
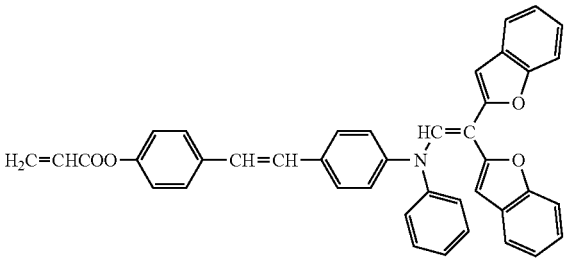
No.47
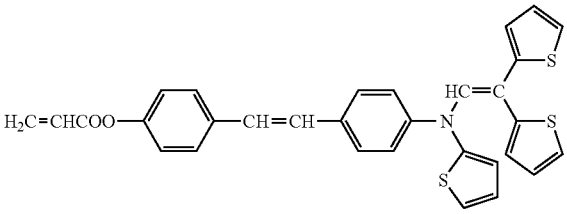

-continued
No.48
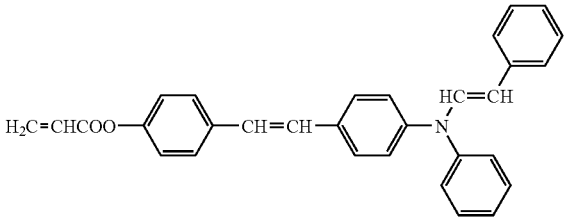
No.49
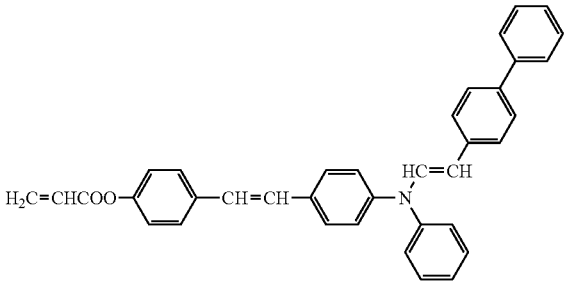
No.50
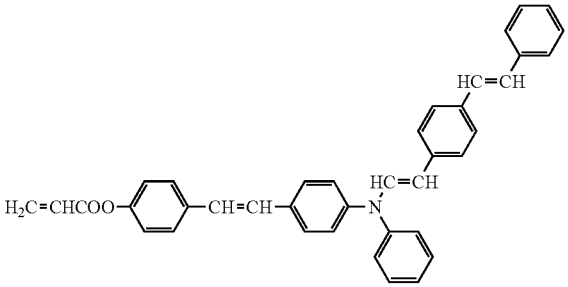
No.51
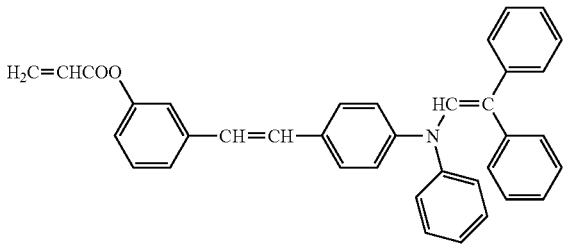
No.52
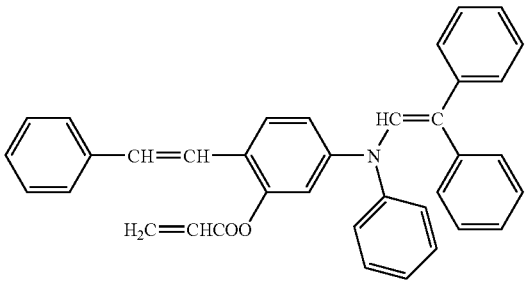
-continued
No.53
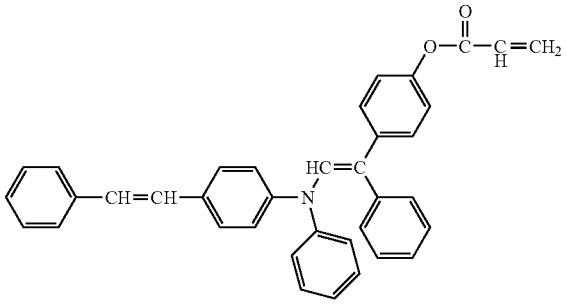
No.54
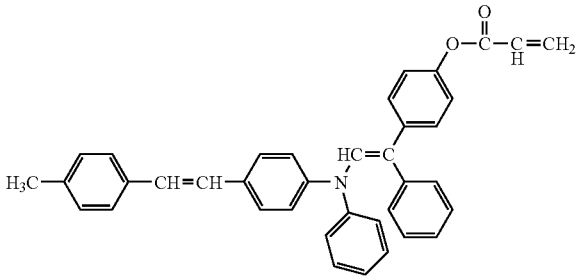
No.55
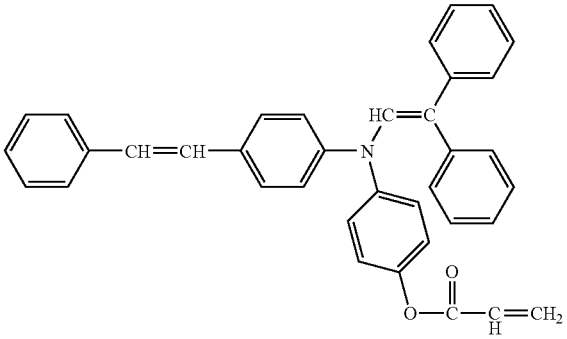
No.56
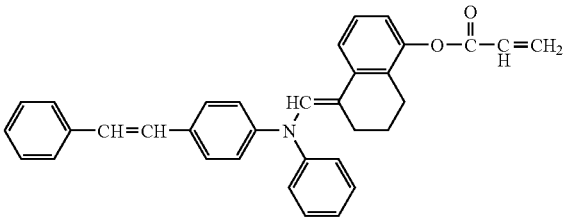
No.57
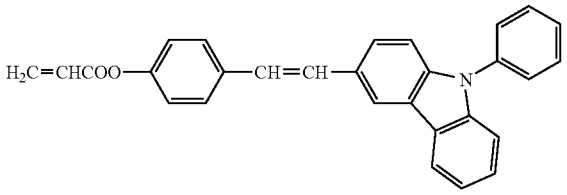

-continued
No.58
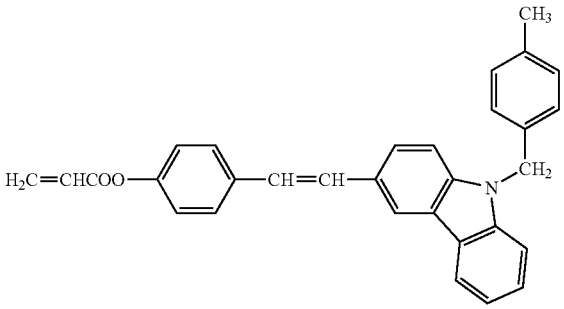
No.59
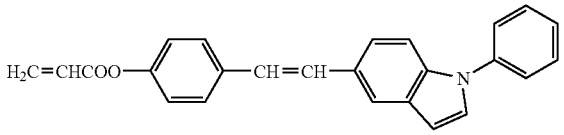
No.60
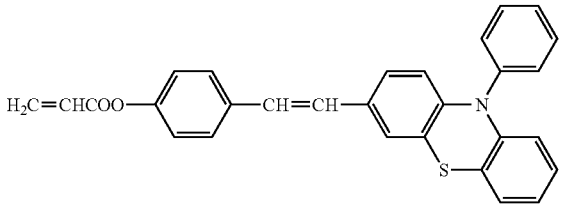
No.61
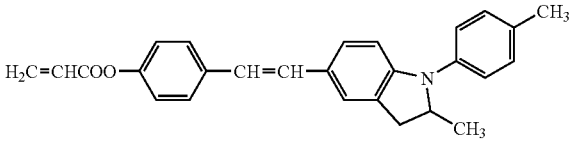
No.62
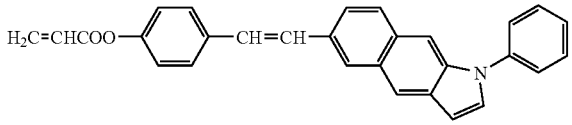
No.63
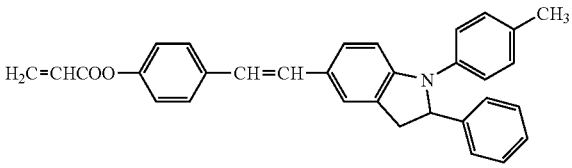
No.64
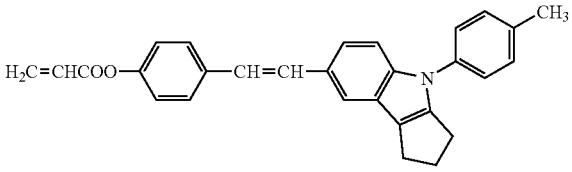
-continued
No.65
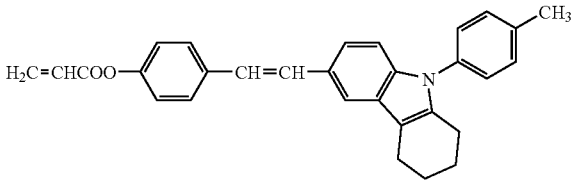
No.66
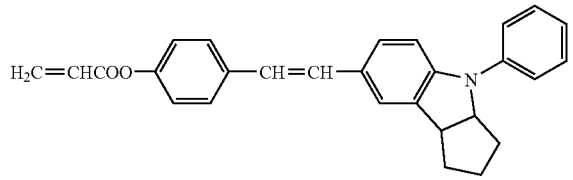
No.67
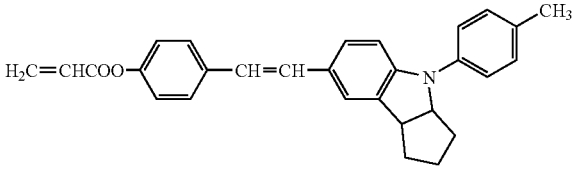
No.68
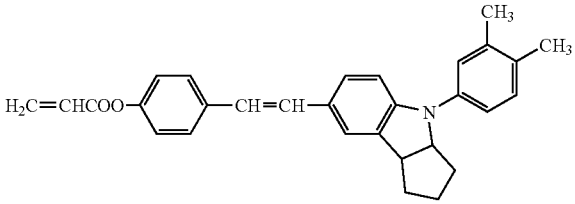
No.69
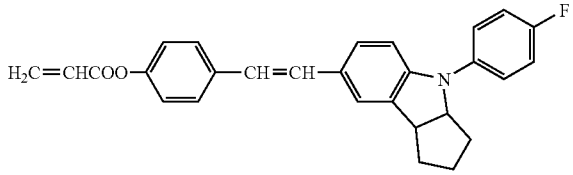
No.70
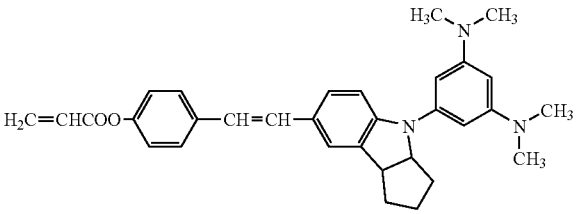
No.71
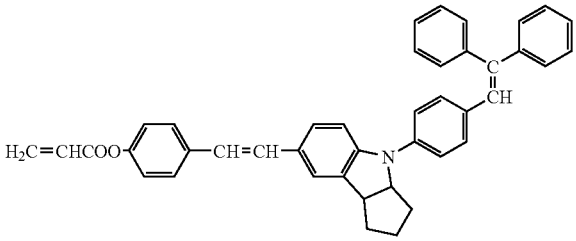

-continued

No.72

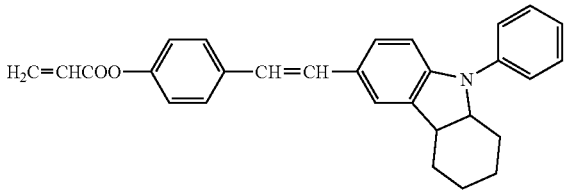

No.73

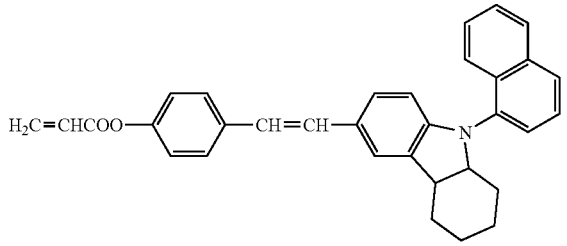

No.74

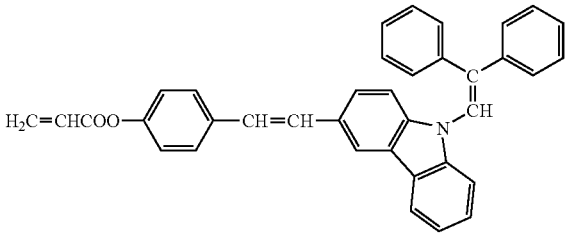

No.75

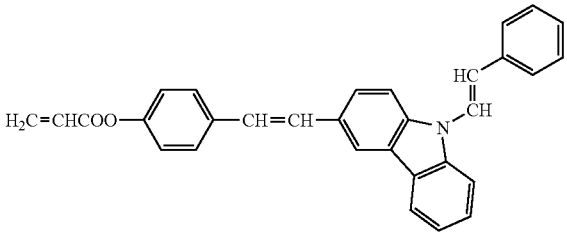

No.76

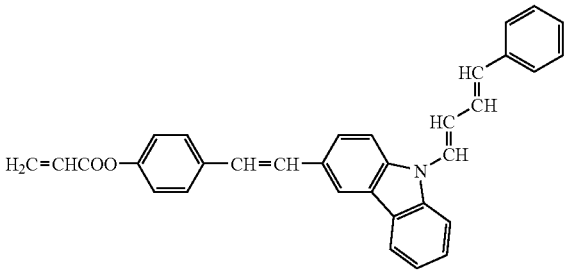

No.77

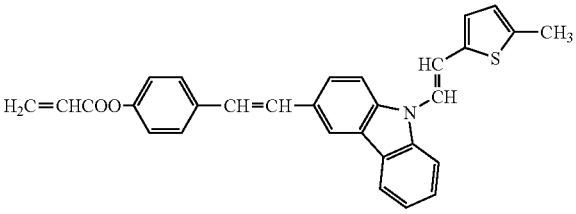

-continued

No.78

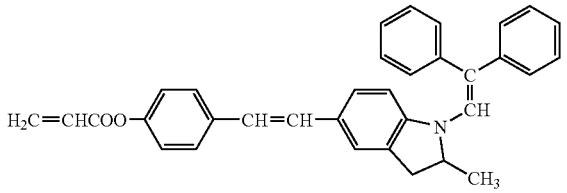

No.79

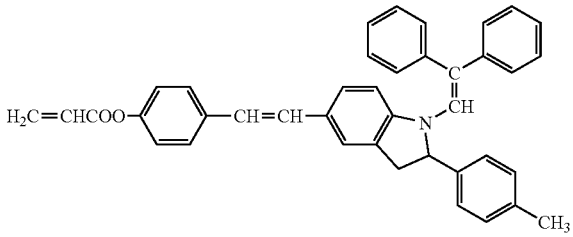

No.80

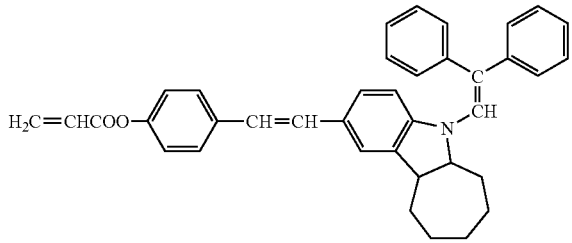

No.81

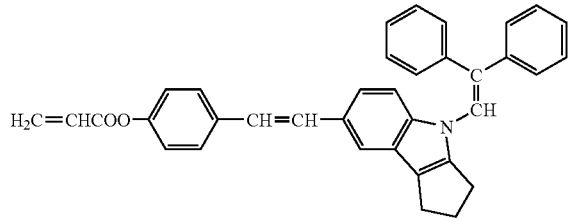

No.82

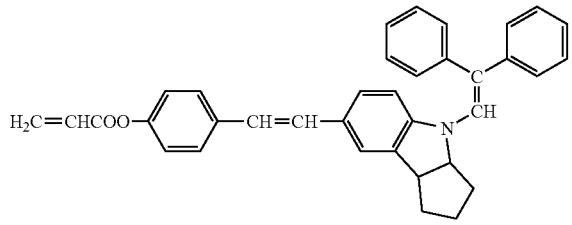

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat coating liquid, a charge generation coating liquid and charge transport coating liquid, which have the following formulations, were coated and dried in this order on an aluminium cylinder having a diameter of 30 mm to form an undercoat layer 3.5 μm thick, a CGL 0.2 μm thick, a CTL 18 μm thick thereon.

Undercoat Layer Coating Liquid

| | |
|---|---|
| Alkyd resin (BEKKOZOL 1307-60-EL from Dainippon Ink & Chemicals, Inc.) | 6 |
| Melamine resin (SUPER BEKKAMIN G-821-60 from Dainippon Ink & Chemicals, Inc.) | 4 |
| Titanium dioxide powder | 40 |
| Methyl ethyl ketone | 50 |

CGL Coating Liquid

| | |
|---|---|
| Polyvinyl butyral (XYHL from Union Carbide Corp.) | 0.5 |
| Cyclohexanone | 200 |
| Methyl ethyl ketone | 80 |
| Bisazo pigment having the following formula (I): | 2.4 |

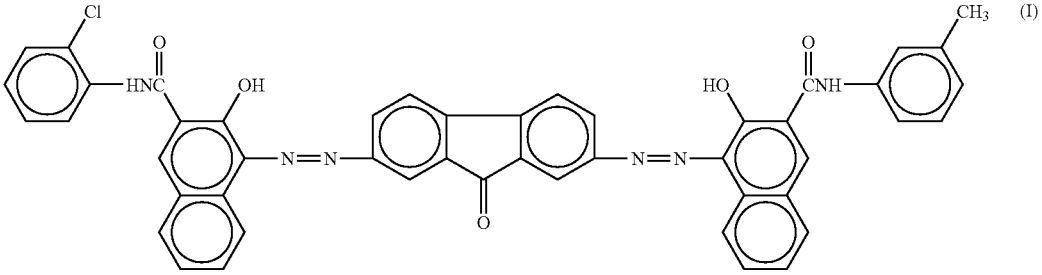

2-[2-hydroxxy-3-(2-chlorophenyl)carbamoyl-1-naphtylazo]-7-[2-hydroxy-3-(3-methylphenyl)carbamoyl-1-naphtylazo]fluorene-9-one CTL Coating Liquid

| | |
|---|---|
| Bisphenol Z Polycarbonate (Panlite TS-2050 from TEIJIN CHEMICALS LTD.) | 10 |
| Tetrahydrofuran | 100 |
| 1% tetrahydrofuran solution of silicone oil (KF50-100CS from Shin-Etsu Chemical Industry Co., Ltd.) | 0.2 |
| Charge transport material having the following formula (II): | 7 |

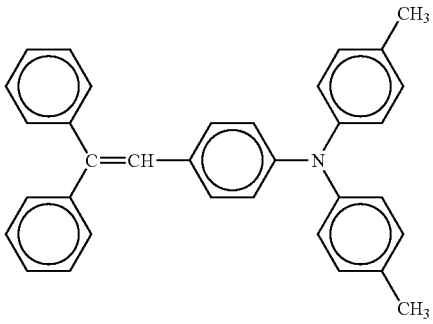

[4-(2,2-diphenylvinyl)phenyl]-di-para-tolylamine

The CTL was further coated with a crosslinked CTL coating liquid having the following formulation by a spray coating method.

Crosslinked CTL Coating Liquid

| | |
|---|---|
| Component A<br>Trimethylolpropanetriacrylate<br>KAYARAD TMPTA from NIPPON KAYAKU CO., LTD., having a molecular weight of 296, 3 functional groups and a ratio of the molecular weigh to the number of functional groups of 99 | 10 |
| Component B<br>Exemplified Compound No. 12 | 10 |
| Component C<br>1-hydroxy-cyclohexyl-phenyl-ketone<br>IRGACURE 184 from CIBA SPECIALTY CHEMICALS | 1 |
| Tetrahydrofuran | 100 |

After naturally dried for 30 min, the crosslinked CTL was irradiated by a metal halide lamp at 160 W/cm, an irradiation distance of 110 mm and an irradiation intensity of 750 mW/cm$^2$ for 240 sec to be hardened. The crosslinked CTL was further dried at 130° C. for 20 min to prepare an electrophotographic photoreceptor of the present invention, having a crosslinked CTL 5.0 μm thick.

Example 2

The procedure for preparation of the electrophotographic photoreceptor in Example 1 was repeated to prepare an electrophotographic photoreceptor except for replacing the component B with the Exemplified Compound No. 14.

Example 3

The procedure for preparation of the electrophotographic photoreceptor in Example 1 was repeated to prepare an electrophotographic photoreceptor except for replacing the component B with the Exemplified Compound No. 13.

Example 4

The procedure for preparation of the electrophotographic photoreceptor in Example 1 was repeated to prepare an electrophotographic photoreceptor except for replacing the component B with the Exemplified Compound No. 11.

Example 5

The procedure for preparation of the electrophotographic photoreceptor in Example 1 was repeated to prepare an electrophotographic photoreceptor except for irradiating a crosslinked CTL thereof with a metal halide lamp for 360 sec.

Example 6

The procedure for preparation of the electrophotographic photoreceptor in Example 1 was repeated to prepare an electrophotographic photoreceptor except for irradiating a crosslinked CTL thereof with a metal halide lamp at an irradiation distance of 120 mm and an irradiation intensity of 500 $mW/cm^2$ for 60 sec.

Example 7

The procedure for preparation of the electrophotographic photoreceptor in Example 1 was repeated to prepare an electrophotographic photoreceptor except for irradiating a crosslinked CTL thereof with a metal halide lamp at an irradiation distance of 120 mm and an irradiation intensity of 500 $mW/cm^2$ for 120 sec.

Example 8

The procedure for preparation of the electrophotographic photoreceptor in Example 1 was repeated to prepare an electrophotographic photoreceptor except for forming a crosslinked CTL 1 μm thick thereon.

Example 9

The procedure for preparation of the electrophotographic photoreceptor in Example 1 was repeated to prepare an electrophotographic photoreceptor except for forming a crosslinked CTL 3 μm thick thereon.

Example 10

The procedure for preparation of the electrophotographic photoreceptor in Example 1 was repeated to prepare an electrophotographic photoreceptor except for forming a crosslinked CTL 7 μm thick thereon.

Example 11

The procedure for preparation of the electrophotographic photoreceptor in Example 1 was repeated to prepare an electrophotographic photoreceptor except for forming a crosslinked CTL 10 μm thick thereon.

Example 12

The procedure for preparation of the electrophotographic photoreceptor in Example 1 was repeated to prepare an electrophotographic photoreceptor except for forming a crosslinked CTL 12 μm thick thereon.

Comparative Example 1

The procedure for preparation of the electrophotographic photoreceptor in Example 1 was repeated to prepare an electrophotographic photoreceptor except for replacing the component B with a compound having the following formula:

Acrylic acid 2-[4-(di-para-tolylamino)phenyl]ethyl ester

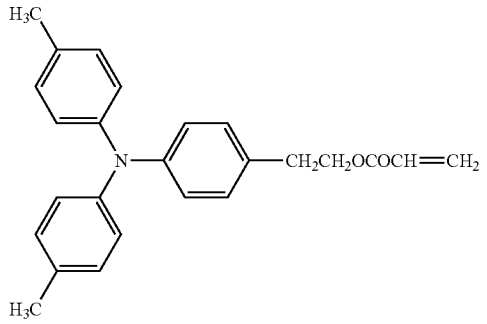

Comparative Example 2

The procedure for preparation of the electrophotographic photoreceptor in Example 1 was repeated to prepare an electrophotographic photoreceptor except for replacing the component B with a compound having the following formula:

2-methyl acrylic acid 4-{2-[4-(di-para-tolylamino)phenyl]ethyl}phenyl ester

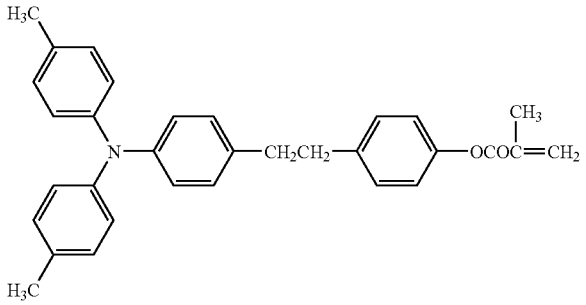

Comparative Example 3

The procedure for preparation of the electrophotographic photoreceptor in Example 1 was repeated to prepare an electrophotographic photoreceptor except for replacing the component B with a compound having the following formula:

Acrylic acid 4'-(di-para-tolylamino)biphenyl-4-yl ester

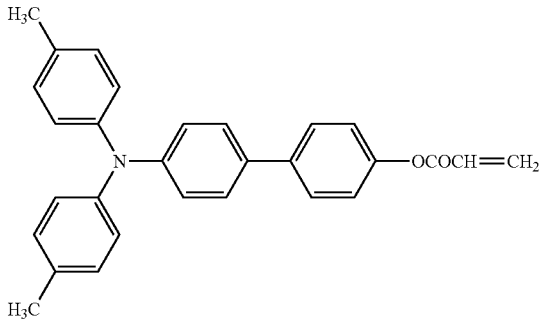

Comparative Example 4

The procedure for preparation of the electrophotographic photoreceptor in Example 1 was repeated to prepare an electrophotographic photoreceptor except for replacing the component B with a compound having the following formula:

Acrylic acid 4-{2-[4-(di-para-tolylamino)phenyl]-1-phenyl vinyl}phenyl ester

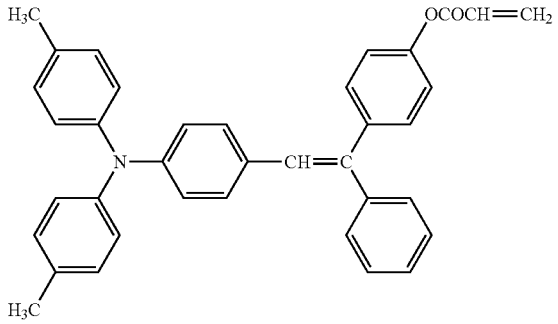

Comparative Example 5

The procedure for preparation of the electrophotographic photoreceptor in Example 1 was repeated to prepare an electrophotographic photoreceptor except for replacing the component B with a compound having the following formula:

Acrylic acid 4-[(4-acryloyloxymethylphenyl)-para-tolylamino]benzyl ester

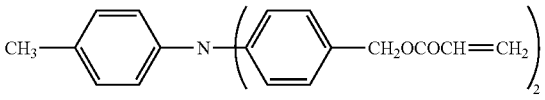

The appearance of each electrophotographic photoreceptor prepared in Examples 1 to 12 and Comparative Examples 1 to 5 was visually observed to see whether it had a crack or a film peeling. In addition, the gel fraction of each crosslinked CTL was measured. Each crosslinked CTL was directly formed on the aluminum substrate under the same conditions in respective Examples and Comparative Examples, which were dipped in tetrahydrofuran at 25° C. for 5 days and the weight residual rate of a gel was determined as the gel fraction. The results are shown in Table 1.

TABLE 1

| | Thickness of crosslinked CTL (μm) | Surface appearance | Gel fraction (%) |
|---|---|---|---|
| Example 1 | 5.0 | Good | 95 |
| Example 2 | 5.0 | Good | 95 |
| Example 3 | 5.0 | Good | 96 |
| Example 4 | 5.0 | Good | 95 |
| Example 5 | 5.0 | Good | 97 |
| Example 6 | 5.0 | Good | 91 |
| Example 7 | 5.0 | Good | 93 |
| Example 8 | 1.0 | Good | 90 |
| Example 9 | 3.0 | Good | 95 |
| Example 10 | 7.0 | Good | 95 |
| Example 11 | 10.0 | Good | 95 |
| Example 12 | 12.0 | Good | 93 |

TABLE 1-continued

| | Thickness of crosslinked CTL (μm) | Surface appearance | Gel fraction (%) |
|---|---|---|---|
| Comparative Example 1 | 5.0 | Good | 95 |
| Comparative Example 2 | 5.0 | Good | 93 |
| Comparative Example 3 | 5.0 | Good | 95 |
| Comparative Example 4 | 5.0 | Good | 90 |
| Comparative Example 5 | 5.0 | Cracked | 97 |

Next, each of the photoreceptors prepared in Examples 1 to 12 and Comparative Examples 1 to 4 was installed in a process cartridge for an electrophotographic image forming apparatus, and the process cartridge was set in a modified imagio Neo 270 from Ricoh Company, Ltd., using a laser diode having a wavelength of 655 nm as an imagewise light source, wherein the initial dark space potential was −700 V. A4-sized 100,000 images were produced thereby with a toner including silica as an external additive, and the initial layer thickness of the photoreceptor and that after 50,000 images were produced were measured to determine an abraded amount thereof. The image after 50,000 images were produced was observed and the number of white spots per unit area thereof was counted. The results are shown in Table 2.

TABLE 2

| | The image after 50,000 images were produced | Abraded amount (μm) | The number of white spots (piece/100 $cm^2$) |
|---|---|---|---|
| Example 1 | Good | 0.7 | 0 to 5 |
| Example 2 | Good | 0.8 | 0 to 5 |
| Example 3 | Good | 0.7 | 0 to 5 |
| Example 4 | Good | 0.8 | 0 to 5 |
| Example 5 | Good | 0.5 | 0 to 5 |
| Example 6 | Good | 1.5 | 5 to 10 |
| Example 7 | Good | 1.3 | 5 to 10 |
| Example 8 | Background fouling slightly occurred | 1.5 | 5 to 10 |
| Example 9 | Good | 0.8 | 0 to 5 |
| Example 10 | Good | 0.9 | 0 to 5 |
| Example 11 | Good | 1.3 | 5 to 10 |
| Example 12 | Image density slightly lowered | 1.8 | 5 to 10 |
| Comparative Example 1 | Image density largely lowered | 1.3 | 10 to 20 |
| Comparative Example 2 | Image density largely lowered | 2.1 | 10 to 20 |
| Comparative Example 3 | Good | 1.2 | 10 to 20 |
| Comparative Example 4 | Background fouling occurred | 2.7 | 10 to 20 |

As seen from the results in Table 2, the electrophotographic photoreceptor of the present invention has good abrasion resistance and produces less-defective images. Particularly, the electrophotographic photoreceptor produces images having less white spots caused by silica stuck thereon and stably produce good images even when used for long periods.

In addition, the photoreceptor having a crosslinked. CTL having a gel fraction not less than 95% scarcely produces defective images. When not less than 97%, the photoreceptor has much better abrasion resistance and scarcely produces defective images. Further, the crosslinked CTL preferably has a thickness of from 3 to 10 μm.

Example 13

The procedure for preparation of the electrophotographic photoreceptor in Example 1 was repeated to prepare an electrophotographic photoreceptor except for replacing the crosslinked CTL coating liquid with a coating liquid having the following formulation.

Crosslinked CTL Coating Liquid

| | |
|---|---|
| Component A-1<br>Trimethylolpropanetriacrylate<br>KAYARAD TMPTA from NIPPON KAYAKU CO., LTD., having a molecular weight of 296, 3 functional groups and a ratio of the molecular weigh to the number of functional groups of 99 | 7.5 |
| Component A-2<br>Dipentaerythritolhexaacrylate<br>KAYARAD DPHA from NIPPON KAYAKU CO., LTD., having a molecular weight of 552, 5.5 functional groups and a ratio of the molecular weigh to the number of functional groups of 100 | 2.5 |
| Component B<br>Exemplified Compound No. 12 | 10 |
| Component C<br>2-hydroxy-cyclohexyl-phenyl-ketone<br>IRGACURE 184 from CIBA SPECIALTY CHEMICALS | 1 |
| Tetrahydrofuran | 120 |

Examples 14 to 16

The procedure for preparation of the electrophotographic photoreceptor in Example 13 was repeated to prepare electrophotographic photoreceptors except for replacing the component B with the Exemplified Compounds Nos. 14, 23 and 66.

Comparative Examples 6

The procedure for preparation of the electrophotographic photoreceptor in Example 13 was repeated to prepare electrophotographic photoreceptors except for replacing the component B with the compound used in Comparative Example 3.

The surface of each photoreceptor prepared in Examples 13 to 16 and Comparative Example 6 was observed with a microscope at a magnification of 50 times to find that each of the photoreceptors photoreceptor prepared in Examples 13 to 16 had a smooth surface like a mirror surface, but the photoreceptor prepared in Comparative Example 6 had small concavities and convexities all over the surface. The average roughness of each of the photoreceptors prepared in Examples 13 to 16 was 0.2 μm and that of the photoreceptor prepared in Comparative Example 6 was 1.1 μm.

The photosensitive layer of the photoreceptor prepared in Examples 13 was peeled off, and a crossly-cut section was prepared by ultramicrotomy. The residual amount of the double-bonding of stilbene structure in the extended section was measured by Microprobe Raman Spectrum Measurer. The surface of the photoreceptor had a residual amount thereof about 5%, and the residual amount gradually increased inward. The deepest part of the crosslinked CTL (at a depth of 5 μm) had a residual amount thereof of 50%. The double-bonding of stilbene structure had such a inclined distribution. The deeper, the less crosslinked, and therefore the surface was harder than the inside.

The photoreceptors prepared in Examples 13 to 16 and Comparative Examples 6 were evaluated by the same method used for evaluating the photoreceptor in Example 1. The results are shown in Tables 3 and 4.

TABLE 3

| | Thickness of crosslinked CTL (μm) | Surface appearance | Gel fraction (%) |
|---|---|---|---|
| Example 13 | 5.0 | Good | 97 |
| Example 14 | 5.0 | Good | 97 |
| Example 15 | 5.0 | Good | 97 |
| Example 16 | 5.0 | Good | 97 |
| Comparative Example 6 | 5.0 | Wrinkled | 95 |

TABLE 4

| | The image after 50,000 images were produced | Abraded amount (μm) | The number of white spots (piece/100 $cm^2$) |
|---|---|---|---|
| Example 13 | Good | 0.5 | 0 to 5 |
| Example 14 | Good | 0.5 | 0 to 5 |
| Example 15 | Good | 0.5 | 0 to 5 |
| Example 16 | Good | 0.5 | 0 to 5 |
| Comparative Example 6 | Stripe image was produced due to defective cleaning | 1.3 | 10 to 20 |

A crosslinked CTL including a mixture of a monomer having 3 functional groups and a monomer having 5 to 6 functional groups has a smooth surface, a high gel fraction and a higher abrasion resistance.

Even after producing 50,000 images, the crosslinked CTL keeps the surface smoothness, has good toner cleanability and stably produces good images with less white spots.

The surface hardness of each of the photoreceptors prepared in Examples 13 to 16 and Comparative Examples 6 was measured by H-100 from Fischer Instruments K.K. using a Vickers indenter at a predetermined load of 9.8 mN. The results are shown in Table 5

TABLE 5

| | Hardness (N/mm2) |
|---|---|
| Example 13 | 235 |
| Example 14 | 231 |
| Example 15 | 232 |
| Example 16 | 235 |
| Comparative Example 6 | 219 |

As shown in Table 5, the electrophotographic photoreceptor of the present invention has a surface harder than that including a compound B other than those of the present invention.

This application claims priority and contains subject matter related to Japanese Patent Application No. 2004-295214 filed on Oct. 7, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising a crosslinked material comprising units obtained from:

a radical polymerizing monomer A having three or more radical polymerizing groups in an amount of 20-80%;

a compound B having the following formula (1):

$$B_1—Ar_1—CH=CH—Ar_2—B_2 \quad (1)$$

wherein $Ar_1$ represents a substituted or an unsubstituted monovalent group or bivalent group formed of an aromatic hydrocarbon skeleton; $Ar_2$ represents a monovalent group or a bivalent group formed of an aromatic hydrocarbon skeleton or heterocyclic compound skeleton having one or more tertiary amino groups; and wherein at least one of $B_1$ and $B_2$ is a hydrogen atom, and the other when not hydrogen is an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group; and optionally a photo polymerization initiator.

2. The electrophotographic photoreceptor of claim 1, wherein the compound B is an ester acrylate compound having the following formula (2):

(2)

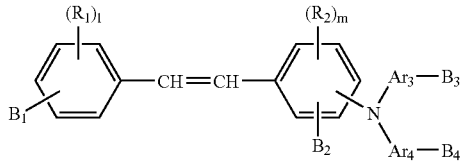

wherein $R_1$ and $R_2$ independently represent a substituted or an unsubstituted alkyl group, a substituted or an unsubstituted alkoxy group or a halogen atom; $Ar_3$ and $Ar_4$ independently represent a substituted or an unsubstituted aryl group, a substituted or an unsubstituted arylene group or a substituted or an unsubstituted benzyl group; one of $B_1$, $B_2$, $B_3$ and $B_4$ represents an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group, and the remainder of $B_1$, $B_2$, $B_3$ and $B_4$ is hydrogen; 1 represents 0 or an integer of from 1 to 5; and m represents 0 or an integer of from 1 to 4.

3. The electrophotographic photoreceptor of claim 1, wherein the compound B is an ester acrylate compound having the following formula (3):

(3)

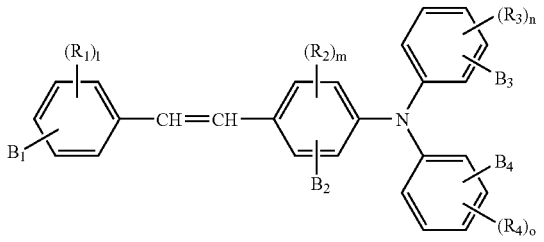

wherein $R_1$, $R_2$, $R_3$ and $R_4$ independently represent a substituted or an unsubstituted alkyl group, a substituted or an unsubstituted alkoxy group or a halogen atom; one of $B_1$, $B_2$, $B_3$ and $B_4$ represents an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group, and the remainder of $B_1$, $B_2$, $B_3$ and $B_4$ is hydrogen; 1, n and o represent 0 or an integer of from 1 to 5; and m represents 0 or an integer of from 1 to 4.

4. The electrophotographic photoreceptor of claim 1, wherein the compound B is a compound having the following formula (4):

(4)

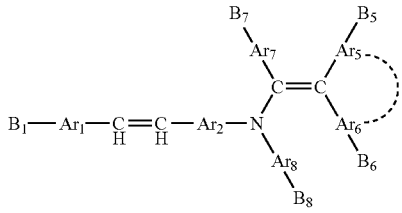

wherein $Ar_1$ and $Ar_2$ independently represent a bivalent substituted or a bivalent unsubstituted alkylene group, a bivalent substituted or a bivalent unsubstituted arylene group or a bivalent substituted or a bivalent unsubstituted heterocyclic group; $Ar_5$, $Ar_6$, $Ar_7$ and $Ar_8$ independently represent a hydrogen atom, a substituted or an unsubstituted alkyl group, a substituted or an unsubstituted aralkyl group, a substituted or an unsubstituted aryl group or a substituted or an unsubstituted heterocyclic group, and $Ar_5$ and $Ar_6$ optionally form a ring structure; and one of $B_1$, $B_5$, $B_6$, $B_7$ and $B_8$ represents an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group, and the remainder of $B_1$, $B_5$, $B_6$, $B_7$ and $B_8$ is hydrogen.

5. The electrophotographic photoreceptor of claim 1, wherein the compound B is a compound having the following formula (5):

(5)

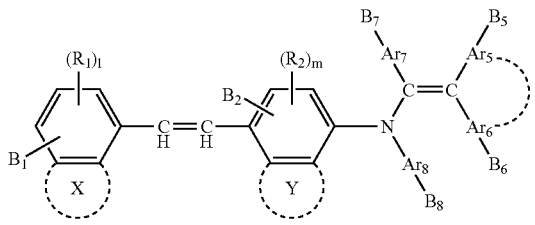

wherein $Ar_5$, $Ar_6$, $Ar_7$ and $Ar_8$ independently represent a hydrogen atom, a substituted or an unsubstituted alkyl group, a substituted or an unsubstituted aralkyl group, a substituted or an unsubstituted aryl group or a substituted or an unsubstituted heterocyclic group, and $Ar_5$ and $Ar_6$ optionally form a ring structure; one of $B_1$, $B_2$, $B_5$, $B_6$, $B_7$ and $B_8$ represents an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group, and the remainder of $B_1$, $B_2$, $B_5$, $B_6$, $B_7$ and $B_8$ is hydrogen; $R_1$ and $R_2$ independently represent a substituted or an unsubstituted alkyl group, a substituted or an unsubstituted alkoxy group or a halogen atom; X ring and Y ring optionally form a ring structure combining an adjacent benzene ring; 1 represents 0 or an integer of from 1 to 5; and m represents 0 or an integer of from 1 to 4.

6. The electrophotographic photoreceptor of claim 1, wherein the compound B is a compound having the following formula (6):

(6)

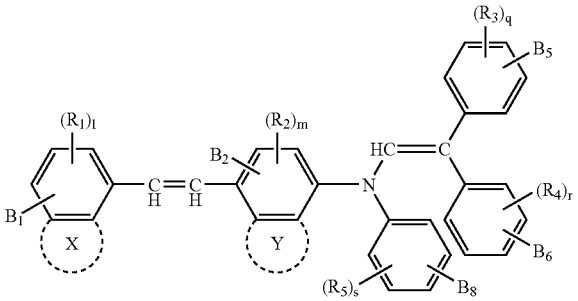

wherein $R_1$, $R_2$, $R_3$, $R_1$, and $R_5$ independently represent a substituted or an unsubstituted alkyl group, a substituted or an unsubstituted aralkyl group, a substituted or an unsubstituted alkoxy group or a halogen atom; one of $B_1$, $B_2$, $B_5$, $B_6$, and $B_8$ represents an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group, and the remainder of $B_1$, $B_2$, $B_5$, $B_6$, and $B_8$ is hydrogen; X ring and Y ring optionally form a ring structure combining an adjacent benzene ring; 1, q, r, s represent 0 or an integer of from 1 to 5; and m represents 0 or an integer of from 1 to 4.

7. The electrophotographic photoreceptor of claim 1, wherein the compound B is a compound having the following formula (7):

(7)

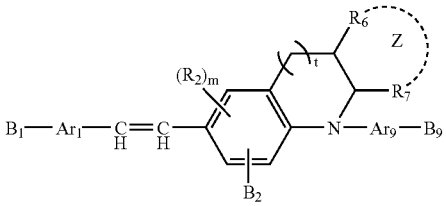

wherein $Ar_1$ and $Ar_9$ independently represent a bivalent substituted or a bivalent unsubstituted alkylene group, a bivalent substituted or a bivalent unsubstituted arylene group or a bivalent substituted or a bivalent unsubstituted heterocyclic group; $R_2$ represent a substituted or an unsubstituted alkyl group, a substituted or an unsubstituted aralkyl group, a substituted or an unsubstituted alkoxy group and a halogen atom; $R_6$ and $R_7$ independently represent a hydrogen atom, a substituted or an unsubstituted alkyl group, a substituted or an unsubstituted aralkyl group, a substituted or an unsubstituted alkoxy group, a substituted or an unsubstituted aryl group, a substituted or an unsubstituted heterocyclic group or a halogen atom, and are optionally bonded with each other to form Z ring; one of $B_1$, $B_2$ and $B_9$ represents an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group, and the remainder of $B_1$, $B_2$ and $B_9$ is hydrogen; m represents 0 or an integer of from 1 to 3; and t represents 0 or an integer of from 1 to 2.

8. The electrophotographic photoreceptor of claim 1, wherein the compound B is a compound having the following formula (8):

(8)

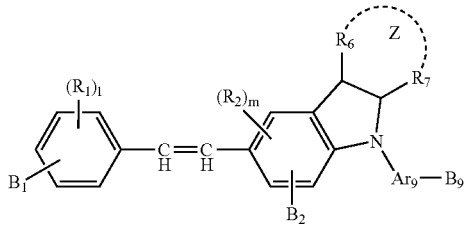

wherein $Ar_1$ and $Ar_9$ independently represent a bivalent substituted or a bivalent unsubstituted alkylene group, a bivalent substituted or a bivalent unsubstituted arylene group or a bivalent substituted or a bivalent unsubstituted heterocyclic group; $R_1$ and $R_2$ independently represent a substituted or an unsubstituted alkyl group, a substituted or an unsubstituted aralkyl group, a substituted or an unsubstituted alkoxy group or a halogen atom; $R_6$ and $R_7$ independently represent a hydrogen atom, a substituted or an unsubstituted alkyl group, a substituted or an unsubstituted aralkyl group, a substituted or an unsubstituted alkoxy group, a substituted or an unsubstituted aryl group, a substituted or an unsubstituted heterocyclic group or a halogen atom, and are optionally bonded with each other to form Z ring; one of $B_1$, $B_2$ and $B_9$ represents an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group, and the remainder of $B_1$, $B_2$ and $B_9$ is hydrogen; 1 represents 0 or an integer of from 1 to 5; and m represents 0 or an integer of from 1 to 3.

9. The electrophotographic photoreceptor of claim 1, wherein the compound B is a compound having the following formula (9):

(9)

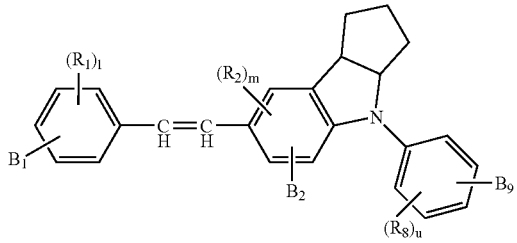

wherein $R_1$, $R_2$ and $R_8$ independently represent a substituted or an unsubstituted alkyl group, a substituted or an unsubstituted aralkyl group, a substituted or an unsubstituted alkoxy group or a halogen atom; one of $B_1$, $B_2$ and $B_9$ represents an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group, and the remainder of $B_1$, $B_2$ and $B_9$ is hydrogen; 1 and u represent 0 or an integer of from 1 to 5; and m represents 0 or an integer of from 1 to 3.

10. The electrophotographic photoreceptor of claim 1, wherein the crosslinked material has a gel fraction not less than 95%.

11. The electrophotographic photoreceptor of claim 1, wherein the crosslinked material has a gel fraction not less than 97%.

12. The electrophotographic photoreceptor of claim 1, wherein the radical polymerizing monomer A having three or more radical polymerizing groups is a mixture of a radical polymerizing monomer having three radical polymerizing groups and a radical polymerizing monomer having 5 to 6 radical polymerizing groups.

13. The electrophotographic photoreceptor of claim 1, further comprising:

an electroconductive substrate;

a charge generation layer located overlying the electroconductive substrate;

a charge transport layer located overlying the charge generation layer; and a crosslinked charge transport layer located overlying the charge transport layer, wherein the crosslinked charge transport layer comprises the crosslinked material.

14. The electrophotographic photoreceptor of claim 13, wherein the crosslinked charge transport layer has a thickness of from 3 to 10 μm.

15. An image forming method comprising:

charging the electrophotographic photoreceptor according to claim 1;

irradiating the electrophotographic photoreceptor to form an electrostatic latent image thereon;

developing the electrostatic latent image with a developer comprising a toner to form a toner image on the electrophotographic photoreceptor; and transferring the toner image onto a transfer sheet.

16. An image forming apparatus comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a developer comprising a toner to form a toner image on the electrophotographic photoreceptor; and a transferer configured to transfer the toner image onto a transfer sheet.

17. A process cartridge detachable from an image forming apparatus, comprising:

the electrophotographic photoreceptor according to claim 1; and at least one of a charger, an image developer, a transferer, a cleaner and a discharger.

* * * * *